US011608994B2

(12) United States Patent
Yuk et al.

(10) Patent No.: US 11,608,994 B2
(45) Date of Patent: Mar. 21, 2023

(54) AIR CONDITIONER

(71) Applicant: Samsung Electronics Co., Ltd., Suwon-si (KR)

(72) Inventors: Chungwan Yuk, Suwon-si (KR); Jeimin Choi, Suwon-si (KR); Hyeonu Park, Suwon-si (KR); Eunsung Jo, Suwon-si (KR); Kyusang Park, Suwon-si (KR); Buyoun Lee, Suwon-si (KR); Hansuk Lee, Suwon-si (KR); Changsoo Lim, Suwon-si (KR); Keunjeong Jang, Suwon-si (KR); Duju Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 309 days.

(21) Appl. No.: 17/130,830

(22) Filed: Dec. 22, 2020

(65) Prior Publication Data

US 2021/0190333 A1 Jun. 24, 2021

(30) Foreign Application Priority Data

Dec. 23, 2019 (KR) ..... 10-2019-0172751

(51) Int. Cl.
*F25D 23/12* (2006.01)
*F24F 1/56* (2011.01)
(Continued)

(52) U.S. Cl.
CPC ..... *F24F 1/56* (2013.01); *F24F 1/16* (2013.01); *F24F 13/20* (2013.01); *F24F 13/30* (2013.01); *F24F 2221/52* (2013.01)

(58) Field of Classification Search
CPC ..... F24F 1/56; F24F 1/16; F24F 13/20; F24F 13/30; F24F 2221/52
(Continued)

(56) References Cited

U.S. PATENT DOCUMENTS 2,315,398 A * 3/1943 Clark ..... F16F 15/067 248/561
6,705,105 B2 * 3/2004 Wendt ..... F28F 9/00 62/298
(Continued)

FOREIGN PATENT DOCUMENTS

CN 105841245 A 8/2016
JP 2004-132313 4/2004
(Continued)

OTHER PUBLICATIONS

Written Opinion of the International Searching Authority (PCT/ISA/237) and International Search Report (PCT/ISA/210) dated Mar. 18, 2021, in corresponding International Patent Application No. PCT/KR2020/018504.

*Primary Examiner* — Claire E Rojohn, III
(74) *Attorney, Agent, or Firm* — Staas & Halsey LLP

(57) ABSTRACT

Disclosed is an air conditioner. The air conditioner includes: an indoor unit and an outdoor unit that circulates a refrigerant between the indoor unit and the outdoor unit, in which the outdoor unit includes a heat exchanger that exchanges heat with the refrigerant and a housing that houses the heat exchanger, the housing includes a first plate that is provided to surround the heat exchanger, and a second plate that is provided to cover an opening formed on an edge of the first plate, has a ventilation hole through which air is circulated between inside and outside of the housing, is made of a material having greater corrosion resistance than that of the first plate, and includes a screw coupling part provided to be coupled to the first plate.

13 Claims, 23 Drawing Sheets

(51) Int. Cl.
*F24F 1/16* (2011.01)
*F24F 13/30* (2006.01)
*F24F 13/20* (2006.01)

(58) Field of Classification Search
USPC ..... 62/259.1
See application file for complete search history.

(56) References Cited

U.S. PATENT DOCUMENTS

| | | | | |
|---|---|---|---|---|
| 7,707,798 | B1 * | 5/2010 | Cullinan | F24F 1/58 52/656.1 |
| 9,228,692 | B2 * | 1/2016 | Wilson, Jr. | F16M 5/00 |
| D761,948 | S | 7/2016 | Schler et al. | |
| 2015/0060029 | A1 * | 3/2015 | Ono | F28D 1/0471 165/162 |
| 2018/0080681 | A1 | 3/2018 | Lee et al. | |
| 2018/0172288 | A1 * | 6/2018 | Kim | F24F 1/0014 |
| 2020/0326079 | A1 * | 10/2020 | Lee | F24F 1/0014 |
| 2020/0348032 | A1 * | 11/2020 | Takahara | F24F 1/56 |
| 2021/0190333 | A1 * | 6/2021 | Yuk | F24F 13/20 |
| 2021/0325056 | A1 * | 10/2021 | Lim | F24F 1/36 |

FOREIGN PATENT DOCUMENTS

| | | | |
|---|---|---|---|
| JP | 2016-80316 | A | 5/2016 |
| KR | 10-2003-0067256 | A | 8/2003 |
| KR | 20-0411747 | Y1 | 3/2006 |
| KR | 10-1489068 | B1 | 1/2015 |
| KR | 6256516 | | 12/2017 |
| KR | 10-2018-0032369 | A | 3/2018 |

* cited by examiner

AIR CONDITIONER

CROSS-REFERENCE TO RELATED APPLICATION

This application is based on and claims priority under 35 U. S. C. § 119 to Korean Patent Application No. 10-2019-0172751, filed on Dec. 23, 2019, the disclosure of which is herein incorporated by reference in its entirety.

BACKGROUND

1. Field

The disclosure relates to an air conditioner that adjusts various properties of air in a used space according to a user's request, and more particularly, to an air conditioner having a structure that reduces corrosion occurring in a coupled structure of a housing in which a discharge port is formed in an outdoor unit installed outdoors corresponding to an indoor unit.

2. Discussion of Related Art

An air conditioner refers to a device provided to adjust properties such as temperature, humidity, cleanliness, and airflow according to requirements of a used space. The air conditioner basically includes a blower that forms airflow, and changes at least one of the properties of air circulated by the blower to change the environment of the used space to a comfortable state for a user. The air conditioner generally refers to a device that cools or heats air, but a dehumidifier for lowering the humidity of air, an air purifier for increasing the cleanliness of air, and the like may also be included in the air conditioner.

The air conditioner uses a cooling principle by heat of vaporization to lower an indoor temperature when operating in a cooling mode. When liquid vaporizes into gas, heat is absorbed, and when gas condenses into liquid, heat is dissipated. Here, heat absorbed when liquid vaporizes is the heat of vaporization. The air conditioner changes pressure by a compressor to condense a gaseous coolant to liquid and then lower the pressure to vaporize the liquefied coolant back into vapor within an evaporator, and absorbs heat by the vaporizing coolant to lower the ambient temperature. In natural phenomena, heat is originally transferred from a high temperature to a low temperature, but transferred from a low-temperature indoor to a high-temperature outdoor as an opposite direction thereto through a cooling cycle of the air conditioner. To this end, the air conditioner includes an indoor unit that emits cold wind by performing vaporization and an outdoor unit that emits hot wind by performing condensation. On the other hand, when the indoor unit performs condensation and the outdoor unit performs vaporization as the air conditioner operates in a heating mode, the indoor unit emits hot wind and the outdoor unit emits cold wind.

The outdoor unit includes a housing provided to house a heat exchanger that performs the condensation or vaporization. The housing includes a first plate that has an opening at an upper side or on a front surface thereof, and a second plate that covers an opening of the first plate and has a discharge port for discharging internal air. The first plate and the second plate are made of a steel plate material, and have a structure in which a screw comes into contact with the first plate and the second plate to couple the first plate and the second plate to each other. Due to this structure, corrosion is likely to occur in regions of the first plate and the second plate that come into contact with the screw. Even if the first plate and the second plate are coated not to corrode, the coating of each region contacting the screw is peeled off due to the coupling by the screw, and therefore does not play a substantial role in preventing corrosion. In addition, due to the nature of the outdoor unit being installed outdoors, since the outdoor unit frequently contacts moisture due to rain, snow, and the like, the corrosion in the regions may become more severe.

From this point of view, a structure capable of reducing corrosion that may occur due to the coupling of the first plate and the second plate may be required.

SUMMARY

According to an embodiment of the disclosure, an air conditioner includes: an indoor unit and an outdoor unit that circulates a refrigerant between the indoor unit and the outdoor unit, in which the outdoor unit includes a heat exchanger that exchanges heat with the refrigerant and a housing that houses the heat exchanger, the housing includes a first plate that is provided to surround the heat exchanger, and a second plate that is provided to cover an opening formed on an edge of the first plate, has a ventilation hole through which air is circulated between inside and outside of the housing, is made of a material having greater corrosion resistance than that of the first plate, and includes a screw coupling part provided to be coupled to the first plate.

In addition, the first plate may have a screw through hole that has a main body of the screw screwed to the screw coupling part of the second plate penetrating therethrough and has a larger diameter than that of the screw coupling part.

In addition, the second plate may include a bent part that is bent and extends parallel to the first plate from an edge of a main body of the second plate and provided with the screw coupling part.

In addition, the first plate and the second plate may be screwed to each other in order from the outside of the housing.

In addition, the air conditioner may further include a washer made of a soft material interposed between a screw head of the screw and the first plate.

In addition, the first plate may be vertically provided on an installation surface, and the second plate may be provided above the first plate.

In addition, the first plate or the second plate may be made of a metal material.

In addition, the material of the first plate may include a steel plate, and a material of a screw receiving part of the second plate may include aluminum.

In addition, a thickness of the second plate may be provided in a range of 2.5 to 3 mm.

In addition, an outer surface of the first plate may be coated with a paint having corrosion resistance.

In addition, the ventilation hole of the second plate may be provided in a mesh shape.

In addition, the housing may further include a mesh, and the second plate may further include a mesh coupling part that is screwed to the mesh covering the ventilation hole and has greater corrosion resistance than that of the mesh.

In addition, the first plate may include a locking protrusion protruding from the first plate to support an edge of the second plate.

BRIEF DESCRIPTION OF THE DRAWINGS

The above and other aspects, features, and advantages of certain embodiments of the disclosure will be more apparent from the following description taken in conjunction with the accompanying drawings.

DETAILED DESCRIPTION

Hereinafter, embodiments according to the disclosure will be described in detail with reference to the accompanying drawings. Embodiments described with reference to each drawing are not mutually exclusive configurations unless otherwise specified, and a plurality of embodiments may be selectively combined and implemented in one apparatus. The combination of the plurality of embodiments may be arbitrarily selected and applied by a person skilled in the art of the disclosure in implementing the spirit of the disclosure.

If there are terms including an ordinal number such as a first component, a second component, and the like in embodiments, these terms are used to describe various components, and the terms are used to distinguish one component from other components, and therefore meaning of these components are not limited by these terms. Terms used in the embodiments are applied to describe the embodiments, and do not limit the spirit of the disclosure.

In addition, in the case where the expression "at least one" among a plurality of components is described in the present specification, this expression refers to not only the whole of a plurality of components, but each one excluding the rest of the plurality of components or all combinations of thereof.

Figure 1:
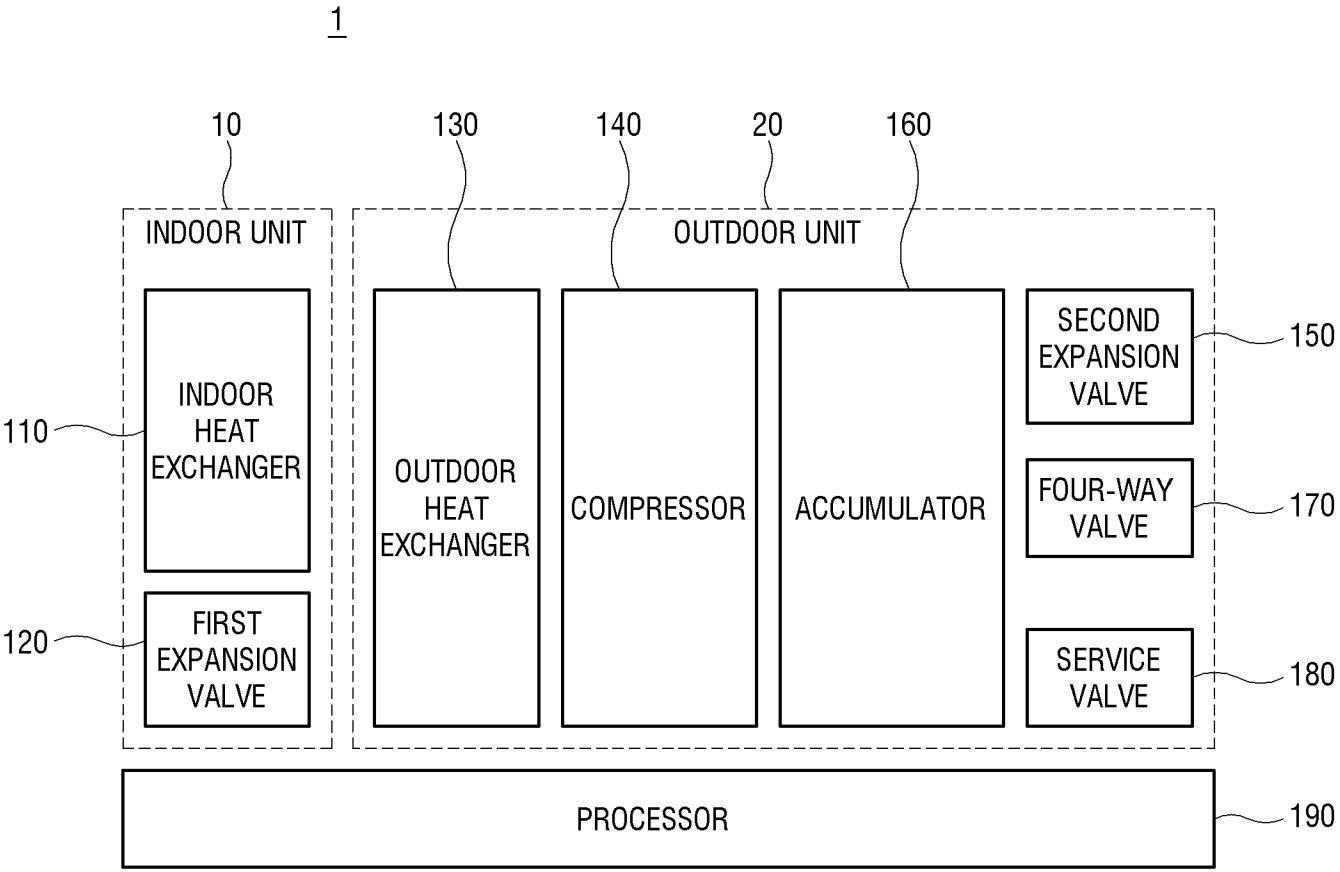
FIG. 1 is a block diagram illustrating a configuration of an air conditioner.

FIG. 1 is a block diagram illustrating a configuration of an air conditioner.

As illustrated in FIG. 1, an air conditioner 1 according to an embodiment of the disclosure includes an indoor unit 10 that is installed in a first location in an environment in which temperature is to be adjusted, such as an inside of a building, and an outdoor unit 20 that is installed in a second location other than the environment, such as an outside of a building. Refrigerants are circulated between the indoor unit 10 and the outdoor unit 20, and the indoor unit 10 and the outdoor unit 20 adjust temperature in the first location by adjusting a state of each refrigerant by energy. The circulation of the refrigerant is achieved by providing a pipe inside the indoor unit 10, a pipe inside the outdoor unit 20, and external pipes connecting between the indoor unit 10 and the outdoor unit 20 to communicate with each other. The number of indoor unit 10 and outdoor units 20, respectively, may be provided to correspond in various ways, such as 1:1, 1:N, M1, and M:N (M and N are two or more natural numbers).

The air conditioner 1 basically uses cooling by heat of evaporation. The refrigerant absorbs heat when vaporized from liquid to gas, but dissipates heat when condensing from gas to liquid. The heat absorbed when the refrigerant vaporizes is the heat of evaporation. Since the air conditioner 1 uses a phase change in which the refrigerant changes between the liquid and the gas, the refrigerant used in the air conditioner 1 has a low vaporization point and a large heat of evaporation. In addition, since the indoor and outdoor pipes of the air conditioner 1 are mainly made of metal, the refrigerant is required to have properties that do not corrode the metal used in the pipe. In addition, when a refrigerant freezes in winter, troublesome situations are caused. Therefore, depending on a region where a refrigerant is used, a refrigerant that may exist in a liquid phase even at a low temperature may be required.

Hereinafter, components provided in the air conditioner 1 will be described. Each of the components is the indoor unit 10 or the outdoor unit 20 whose installation locations are distinguished. The air conditioner 1 is not implemented only by the components of the air conditioner 1 described below. Various design methods may be applied to the air conditioner 1 as necessary, and therefore, the air conditioner 1 may include additional components not described in this embodiment.

For example, the indoor unit 10 includes an indoor heat exchanger 110, a first expansion valve 120, and the like. The outdoor unit 20 includes an outdoor heat exchanger 130, a compressor 140, a second expansion valve 150, an accumulator 160, and a four-way valve 170, a service valve 180, and the like. In addition, pipes forming various paths are installed between these components, and as a result, a refrigerant moves between the components.

Hereinafter, each component will be briefly described.

The indoor heat exchanger 110 performs a heat-related interaction between the refrigerant and the atmosphere, and thus, adjusts a phase change of the refrigerant and a temperature of the surrounding environment. The indoor heat exchanger 110 operates as an evaporator when the air conditioner 1 is in a cooling mode, and operates as a condenser when the air conditioner 1 is in the heating mode. The indoor heat exchanger 110 causes an endothermic reaction by evaporating a refrigerant in the cooling mode, so the refrigerant changes to a gas phase and the temperature of the surrounding environment is lowered. The indoor heat exchanger 110 causes an exothermic reaction by condensing a high-temperature and high-pressure refrigerant in the heating mode, so the refrigerant changes to a liquid phase and the temperature of the surrounding environment rises.

The first expansion valve 120 expands a refrigerant condensed by the outdoor heat exchanger 130 in the cooling mode and transfers the expanded refrigerant to the indoor heat exchanger 110. The first expansion valve 120 lowers a pressure of a refrigerant by passing the refrigerant through a path whose diameter is relatively reduced, so the refrigerant may be easily evaporated later.

The outdoor heat exchanger 130 has a basic operation method similar to that of the indoor heat exchanger 110. However, the outdoor heat exchanger 130 operates opposite to the indoor heat exchanger 110 in each mode. That is, the outdoor heat exchanger 130 operates as a condenser in the cooling mode and operates as an evaporator in the heating mode. The outdoor heat exchanger 130 serves to lower the indoor temperature by dissipating absorbed heat from the indoor heat exchanger 110 in the cooling mode, and vice versa in the heating mode.

The compressor 140 compresses a gaseous cold refrigerant delivered from the indoor heat exchanger 110 or the outdoor heat exchanger 130 that serves as an evaporator for each mode, and adjusts the refrigerant to a high-temperature and high-pressure gas phase. When the compressor 140 compresses the refrigerant, a phase change from a high temperature to a liquid phase may be easily performed. In addition, the compressor 140 absorbs the low-pressure refrigerant and discharges the high-pressure refrigerant, thereby imparting a force to the refrigerant so that the refrigerant forms a circulation cycle in the air conditioner 1.

The second expansion valve 150 is the same as the first expansion valve 120 in terms of the function of expanding the refrigerant. The second expansion valve 150 expands a refrigerant condensed by the indoor heat exchanger 110 in the heating mode and transfers the expanded refrigerant to the outdoor heat exchanger 130.

The accumulator 160 allows only gaseous refrigerant among the introduced refrigerants to be transferred to the compressor 140. In some cases, the evaporated refrigerant may be not completely evaporated and contain some liquid phases.

The four-way valve 170 switches the path of the refrigerant in the outdoor unit 20 in response to one of the cooling mode and the heating mode. The four-way valve 170 adjusts the movement of the refrigerant in response to the current mode, and thus, the operation of the indoor heat exchanger 110 and the outdoor heat exchanger 130 is switched for each mode.

The service valve 180 is a valve provided to allow an administrator to adjust a vacuum state and supplement the refrigerant in the circulation cycle of the refrigerant through all the pipes of the air conditioner 1. When the cooling and heating efficiency decreases due to the insufficient refrigerant in the cycle as the use time elapses, an additional refrigerant may be supplemented through the service valve 180.

In addition, the air conditioner 1 includes a controller or a processor 190 that controls and instructs operations of structures including the above-described components of the air conditioner 1. The processor 190 is implemented as hardware circuits such as a CPU mounted on a printed circuit board, a micro-processor, a micro-controller, a chipset, and a system-on-chip (SOC). The processor 190 may be installed in the indoor unit 10 or the outdoor unit 20, may be installed in the indoor unit 10 and the outdoor unit 20, respectively, or may be as a separate device other than the indoor unit 10 and the outdoor unit 20.

Hereinafter, the outdoor unit 20 will be additionally described.

Figure 2:
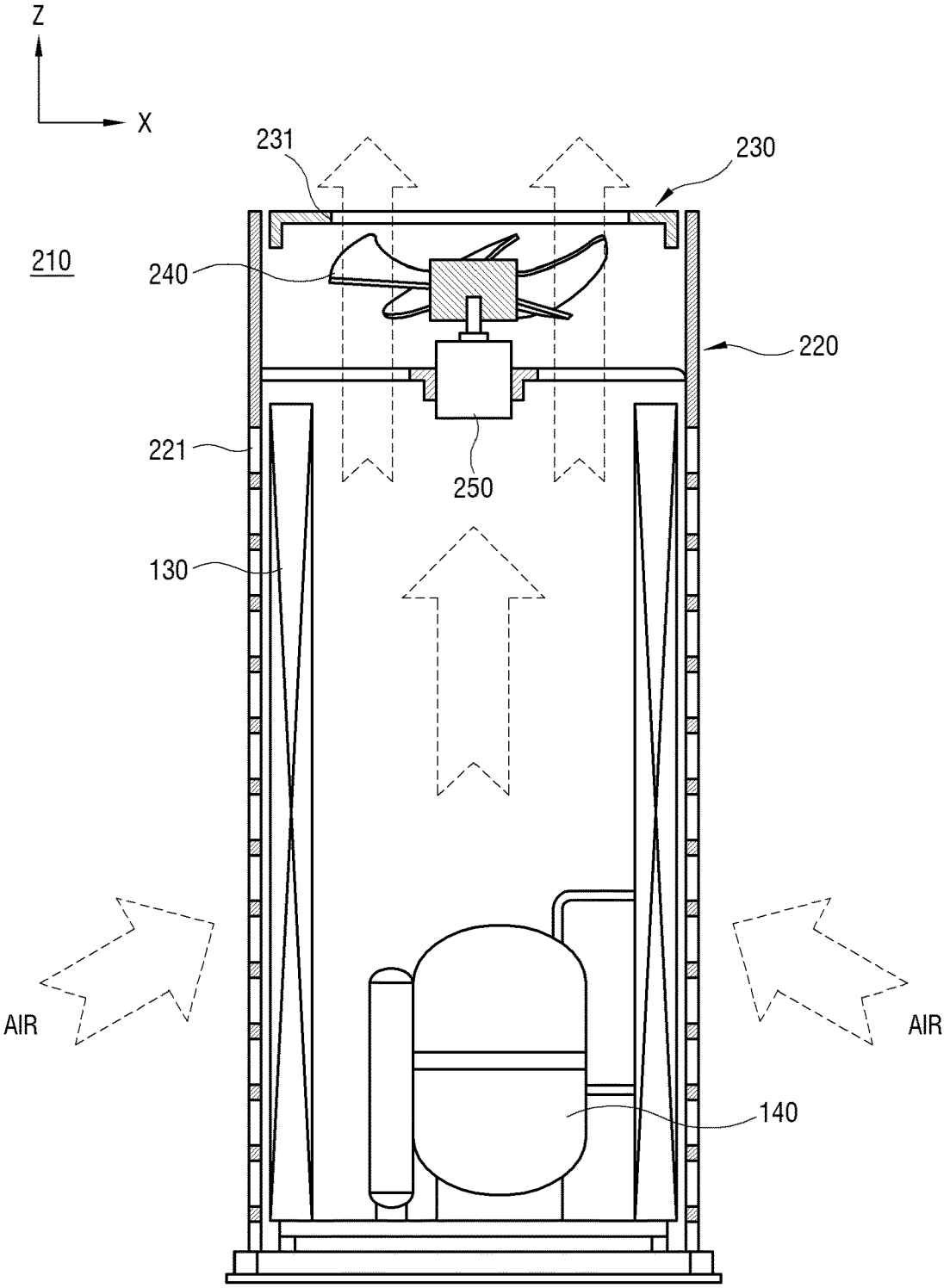
FIG. 2 is a side cross-sectional view schematically illustrating an outdoor unit of the air conditioner.

FIG. 2 is a side cross-sectional view schematically illustrating an outdoor unit of the air conditioner.

As illustrated in FIG. 2, the outdoor unit 20 includes a housing 210. The compressor 140 is housed in a lower portion of the housing 210 and compresses a refrigerant. The outdoor heat exchanger 130 is provided around the compressor 140 in the housing 210 and performs heat exchange between air around the outdoor unit 20 and the refrigerant. In addition, the outdoor unit 20 includes a fan 240 that is housed in the upper portion of the housing 210 and flows air so that outdoor air passes through the housing 210 and heat exchange is performed in the outdoor heat exchanger 130. The outdoor unit 20 includes a driver 250 that drives the fan 240.

In FIG. 2, X and Z directions are illustrated. A Z direction is a vertical direction, and the X direction is a horizontal direction orthogonal to the Z direction. Although not illustrated in FIG. 2, the Y direction is a horizontal direction orthogonal to the Z direction and is orthogonal to the X direction. In the following embodiments, descriptions will be made based on the definition of the direction described above.

The outdoor unit 20 of this embodiment is provided so that air inside the housing 210 moves in the Z direction and is discharged upward. The housing 210 houses the outdoor heat exchanger 130 and the compressor 140 and includes a first plate 220 whose upper side is open. In addition, the housing 210 includes a second plate 230 that covers the upper side of the first plate 220.

The first plate 220 extends along the Z direction to form a side wall of the housing 210. The first plate 220 has a suction port 221 penetrating therethrough so that air outside the housing 210 is sucked into the housing 210. The air sucked through the suction port 221 is heat-exchanged while passing through the outdoor heat exchanger 130 and moves to the upper side of the housing 210.

The second plate 230 has a parallel plate surface along the X direction, and is provided to face the fan 240 by covering the open upper side of the first plate 220. The plate surface of the second plate 230 facing the fan 240 is provided with a discharge port 231 penetrating therethrough so that the air inside the housing 210 is discharged to the outside of the housing 210. The air inside the housing 210 is discharged in the Z direction through the discharge port 231 via the rotating fan 240.

Hereinafter, a support structure of the first plate 220 and the second plate 230 will be described.

Figure 3:
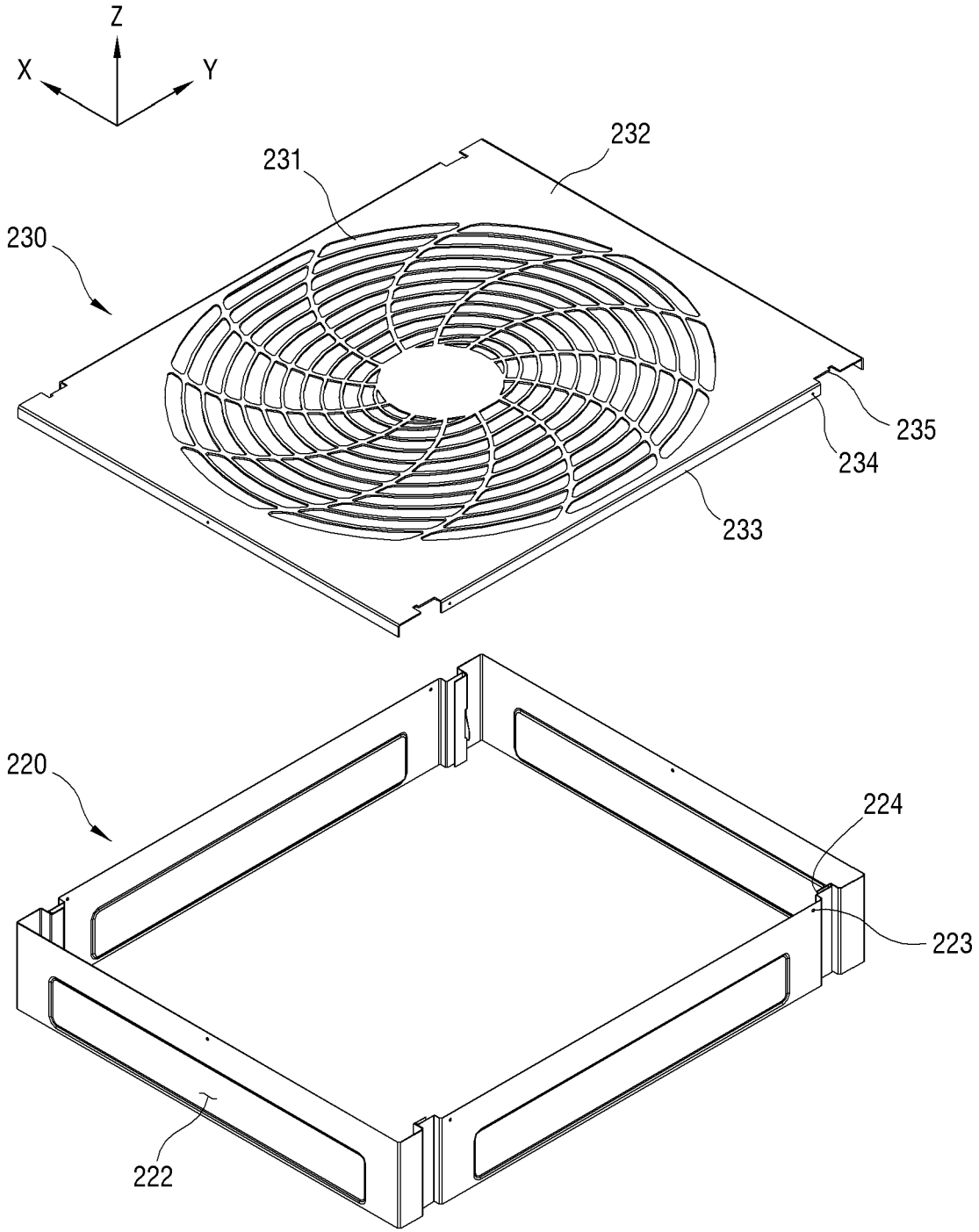
FIG. 3 is a perspective view of main parts illustrating a state in which a second plate of a housing of the outdoor unit is separated from a first plate.

FIG. 3 is a perspective view of main parts illustrating a state in which a second plate of a housing of the outdoor unit is separated from a first plate.

Figure 4:
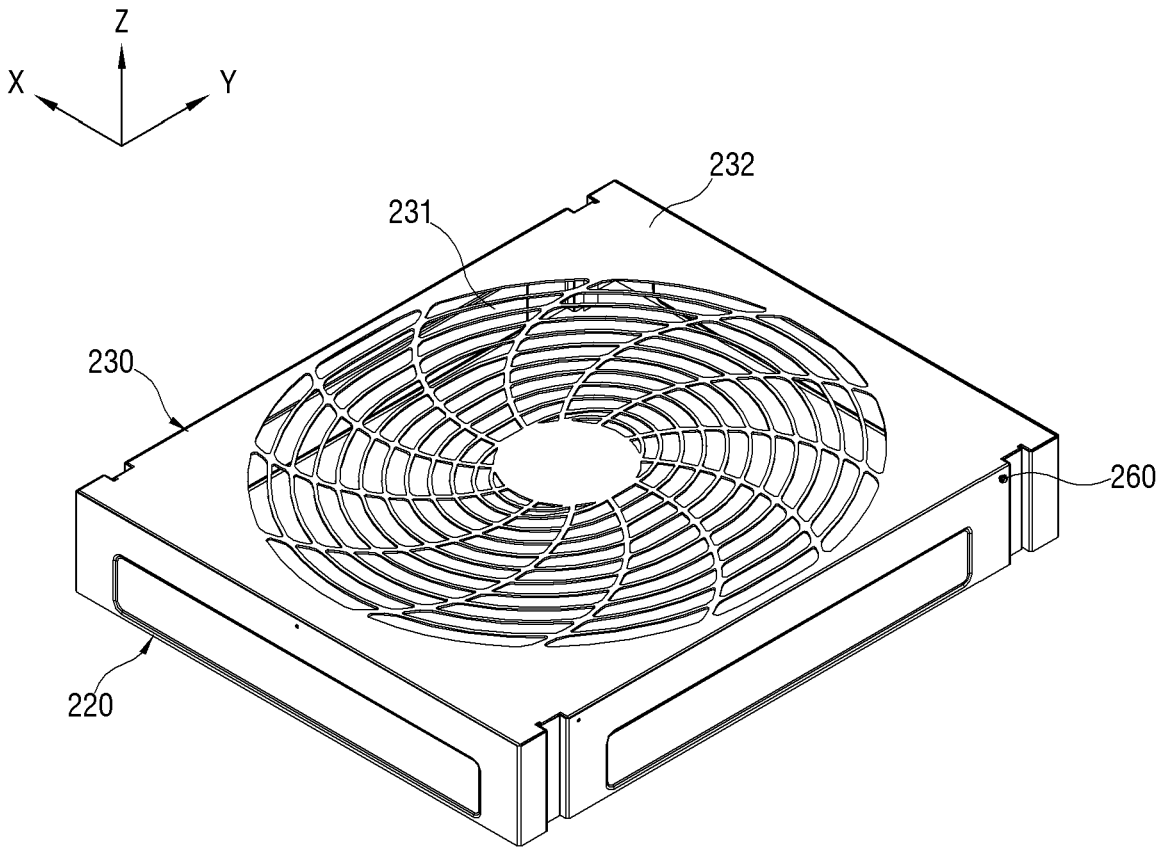
FIG. 4 is a perspective view of main parts illustrating a state in which the second plate of the housing of the outdoor unit is coupled to the first plate.

FIG. 4 is a perspective view of main parts illustrating a state in which the second plate of the housing of the outdoor unit is coupled to the first plate.

As illustrated in FIGS. 3 and 4, in this embodiment, the entire of the first plate 220 is not illustrated, but only upper main parts of the first plate 220 to which the second plate 230 is coupled and supported is illustrated.

The first plate 220 includes a side wall plate 222 that is erected to form a housing space in the housing 210. In this embodiment, two pairs of side wall plates 222 extending in parallel along the Z direction form a square pillar, but this is only an example of one shape, and the structure or shape of the first plate 220 is not limited. An end portion of the first plate 220 in the Z direction, which is constituted by the side wall plate 222, is opened, so the air inside the first plate 220 is discharged to the outside. The first plate 220 or the side wall plate 222 may be made of a metal material in consideration of rigidity, such as a steel plate.

The first plate 220 includes a screw through hole 223 that is formed to penetrate through one region of the side wall plate 222, for example, an upper region of the side wall plate 222. When the second plate 230 is supported by the first plate 220 (see FIG. 4), the screw through hole 223 is provided at a position corresponding to the screw coupling part 234 of the second plate 230 to be described later. The screw through hole 223 is a component involved in coupling of the first plate 220 and the second plate 230 by a screw 260, and a detailed description thereof will be described later.

The first plate 220 includes a locking protrusion 224 that is provided to seat the first plate 220 in one region of the side wall plate 222, for example, at a position close to an upper edge of the side wall plate 222. The locking protrusion 224 is provided so that a locking part 235 of the first plate 220 to be described later is seated, and a detailed description thereof will be described later.

The first plate 220 includes the locking protrusion 224 that extends inward (inward of the housing) from one region of the side wall plate 222, for example, the upper edge of the side wall plate 222. The first locking protrusion 224 is provided to support the first locking part 235 to be described later of the second plate 230.

The first plate 220 includes a second locking protrusion 225 that extends from an inner side surface of the side wall plate 222 close to the first locking protrusion 224 to have a step from the first locking protrusion 224. The second locking protrusion 225 is provided so that a second locking part 236 to be described later of the second plate 230 is seated.

The second plate 230 is provided corresponding to the shape of the opening to cover the opening of the first plate 220. The second plate 230 is a rectangular plate and has a discharge port 231 including a plurality of holes in a central region thereof. The second plate 230 is made of a metal material in consideration of corrosion resistance, such as aluminum.

The material of each of the first plate 220 and the second plate 230 is not limited. For example, in consideration of various matters required for the housing of the outdoor unit, the first plate 220 may be made of a metal material having excellent rigidity, and the second plate 230 may be made of a metal having better corrosion resistance than that of the first plate 220.

The second plate 230 includes a cover plate 232 that has the discharge port 231 formed in a central region thereof. The cover plate 232 corresponds to the shape of the opening of the first plate 220 and has a size to cover the opening of the first plate 220. The cover plate 232 has a rectangular plate surface parallel to an X-Y plane in FIG. 4. A thickness of the second plate 230 or a thickness of the cover plate 232 may be determined in consideration of various factors. For example, when the cover plate 232 is made of an aluminum material, the thickness of the cover plate 232 is provided in the range of 2.5 mm to 3 mm. When the cover plate 232 has a thickness of less than 2.5 mm, the rigidity of the second plate 230 is not secured, and when the cover plate 232 has a thickness exceeding 3 mm, the manufacturing cost excessively increases. In consideration of this point, the cover plate 232 has the thickness within the above-described range.

In addition, the second plate 230 has a bent part 233 that is bent downward from the cover plate 232. The bent part 233 extends orthogonally in a −Z direction by a predetermined length from the edge of the cover plate 232 toward the first plate 220. The extended length or shape of the bent part 233 is not limited. The bent part 233 may be provided at all four-way edges of the rectangular cover plate 232, or may be provided only at two edges facing each other among the four-way edges of the cover plate 232.

However, when the second plate 230 is supported by the first plate 220 (see FIG. 4), the bent part 233 is provided to be housed in the first plate 220, that is, into the housing. To this end, a width of the cover plate 232 in contact with the bent part 233 is provided smaller than that of the opening of the first plate 220, so all the bent parts 233 of the second plate 230 may be provided to be inserted into the inside of the first plate 220. This structure is a scheme that considers corrosion prevention in coupling the second plate 230 to the first plate 220, and a detailed description thereof will be described later.

In addition, the second plate 230 includes the screw coupling part 234 that includes a coupling hole formed to penetrate through the bent part 233 so that the screw 260 is coupled to the second plate 230. The screw coupling part 234 extends orthogonal to the extending direction of the bent part 233, that is, parallel to the X direction or the Y direction. The screw coupling part 234 is provided to be screwed to the screw 260 by having a thread formed on an inner circumferential surface thereof that is formed to penetrate through the bent part 233.

In addition, the second plate 230 includes the first locking part 235 supported by the first locking protrusion 224 of the first plate 220. The first locking part 235 is formed by a region depressed from the edge of the first plate 220 toward the inner region of the first plate 220 to house the first locking protrusion 224. The movement in a transverse direction (that is, X direction and Y direction) of the first locking part 235 housing the first locking protrusion 224 is limited by the first locking protrusion 224. As a result, the second plate 230 is supported by the first plate 220.

In addition, the second plate 230 includes the second locking part 236 supported by the second locking protrusion 225 of the first plate 220.

When the second plate 230 is coupled to the first plate 220, the bent part 233 is provided inside the side wall plate 222 so that the second plate 230 covers the opening of the first plate 220. The second locking part 236 is supported by the second locking protrusion 225 to prevent the second plate 230 from falling into the housing space in the first plate 220. The screw 260 from the outside of the first plate 220 is housed in and coupled to the screw through hole 223 and the screw coupling part 234, so the second plate 230 is coupled to the first plate 220.

Hereinafter, the coupled structure of the first plate 220 and the second plate 230 will be described in more detail.

Figure 5:
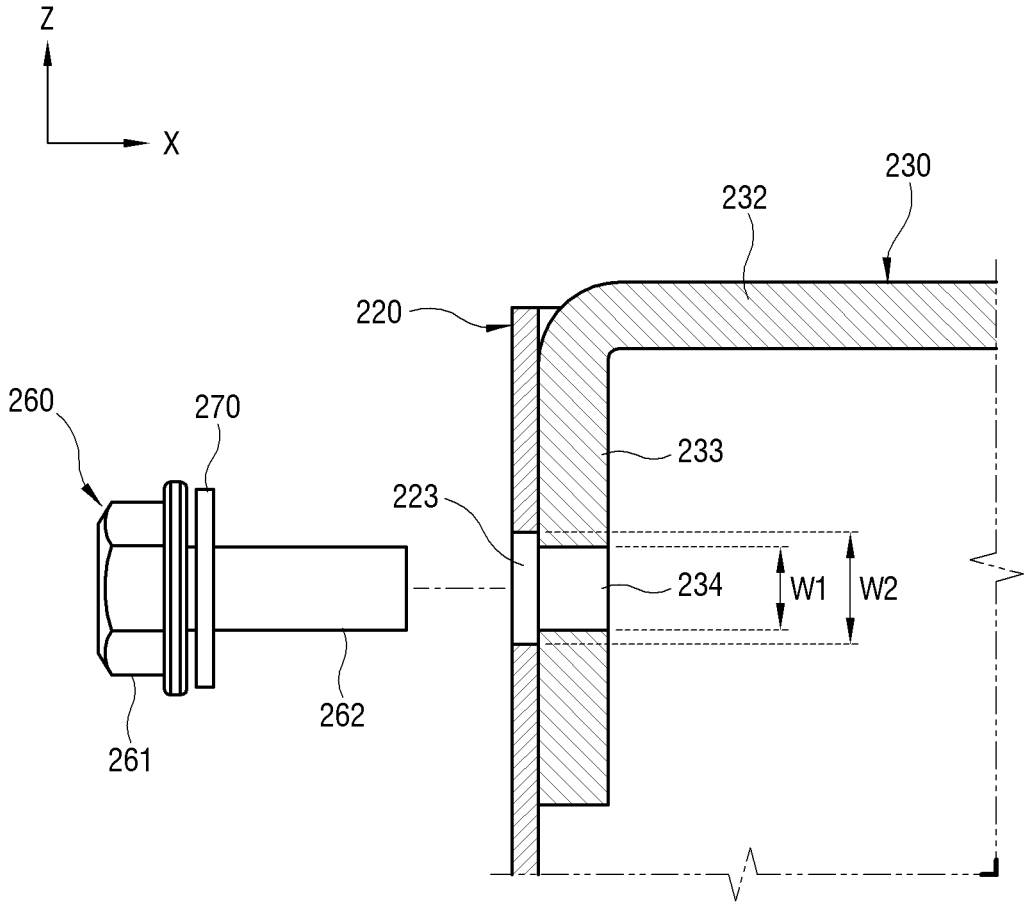
FIG. 5 is a side cross-sectional view of main parts illustrating a coupled structure of the first plate and the second plate by a screw.

FIG. 5 is a side cross-sectional view of main parts illustrating the coupled structure of the first plate and the second plate by the screw.

As illustrated in FIG. 5, the second plate 230 is provided to cover the opening formed at the edge of the first plate 220. The cover plate 232 of the second plate 230 faces upward, and the bent part 233 is provided to be housed inside the first plate 220. In this state, the screw through hole 223 of the first plate 220 and the screw coupling part 234 of the second plate 230 are disposed at positions corresponding to each other, that is, at a position where the screw through hole 223 and the screw coupling part 234 communicate with each other. When a user looks from the outside of the first plate 220 and from a left side of the first plate 220 toward the X direction in the case of FIG. 5, the inside of the first plate 220 is visible through the screw through hole 223 and the screw coupling part 234.

In this state, the screw 260 penetrates through the screw through hole 223 from the outside of the first plate 220 and from the left side of the first plate 220 in the case of FIG. 5 and is screwed to the screw coupling part 234. The screw 260 includes a head 261 that is implemented as a circular or polygonal plate, and a screw body 262 that extends from the head 261 to a predetermined length and has a thread provided to be screwed to an outer circumferential surface thereof. A diameter of the head 261 is provided larger than that of the screw body 262.

A diameter W1 of the screw coupling part 234 corresponds to that of the screw body 262, so the screw body 262 and the screw coupling part 234 are screwed to each other. Here, a diameter W2 of the screw through hole 223 satisfies W2>W1, so that screw body 262 screwed to the screw coupling part 234 is provided not to come into contact with the screw through hole 223.

In addition, a washer 270 is interposed between the head 261 and the first plate 220. The washer 270 is a ring-shaped member that is made of a soft material having strong corrosion resistance such as plastic, resin, and rubber and has a hole formed in a center thereof. The washer 270 prevents the head 261 from coming into contact with the first plate 220 while the screw body 262 is screwed to the screw coupling part 234.

The coupled structure of the first plate 220 and the second plate 230 is summarized as follows. The screw body 262 of the screw 260 penetrates through the screw through hole 223 of the first plate 220 to minimize the contact with the screw through hole 223, and thus, is screwed to the screw coupling part 234 of the second plate 230. The washer 270 blocks the contact between the head 261 of the screw 260 and the first plate 220. The first plate 220 is interposed between the head 261 of the screw 260 and the bent part 233 of the second plate 230, so the screw 260 comes into minimal contact with the first plate 220 having relatively weak corrosion resistance and the screw 260 comes into contact with the second plate 230 having relatively strong corrosion resistance.

As a result, it is possible to couple the second plate 230 to the first plate 220 while preventing corrosion that may occur when the screw 260 comes into contact with the first plate 220.

Additionally, plating or coating treatment for preventing corrosion may be performed on the first plate 220, including the screw through hole 223. According to this embodiment, since the contact of the screw 260 with the first plate 220 is minimized, it is possible to prevent the plating or coating of the first plate 220 from peeling off due to the contact of the screw 260.

Hereinafter, a structure of the locking part and the locking protrusion that prevents the second plate from falling will be described.

Figure 6:
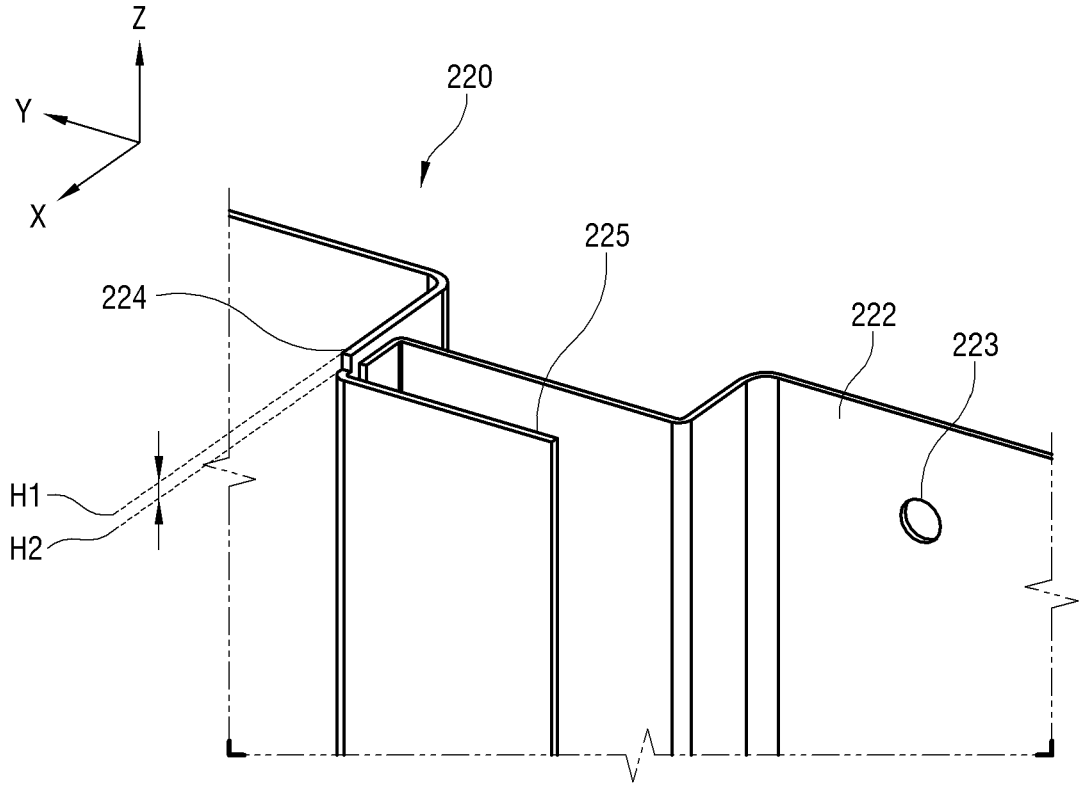
FIG. 6 is a perspective view of main parts illustrating a structure of a locking protrusion of the first plate as viewed from the inside of the first plate.

FIG. 6 is a perspective view of main parts illustrating a structure of the locking protrusion of the first plate as viewed from the inside of the first plate.

Figure 7:
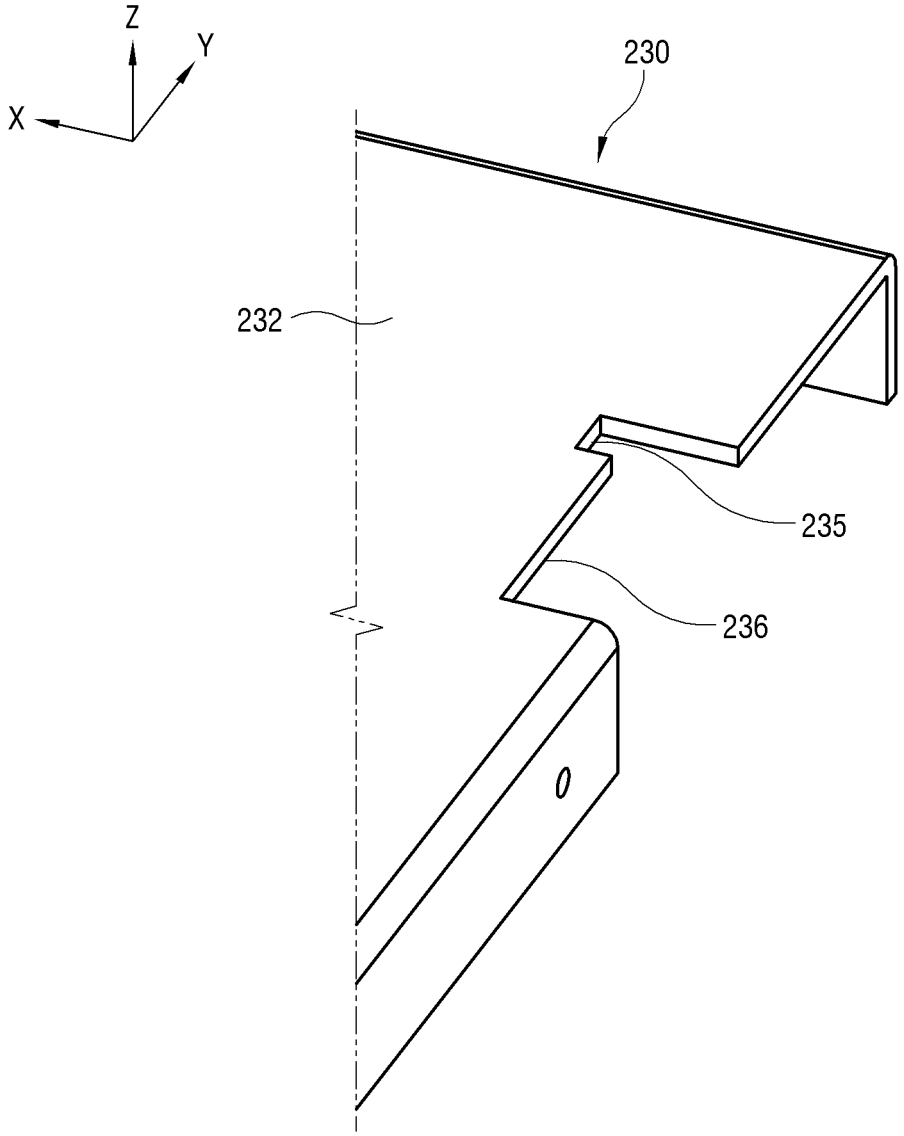
FIG. 7 is a perspective view of main parts illustrating a structure of a locking part of the second plate.

FIG. 7 is a perspective view of main parts illustrating a structure of the locking part of the second plate.

Figure 8:
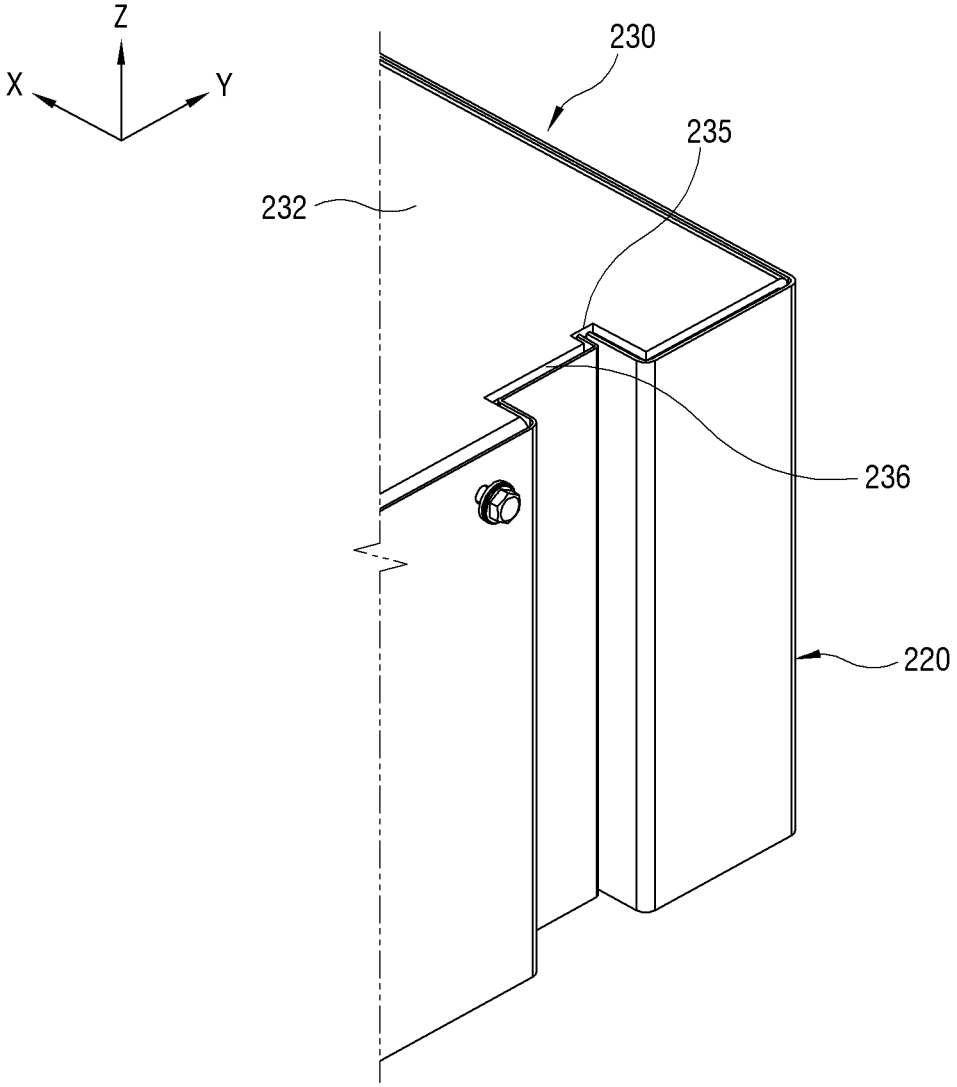
FIG. 8 is a perspective view of main parts illustrating a state in which the locking part is supported on the locking protrusion as viewed from the outside.

FIG. 8 is a perspective view of main parts illustrating a state in which the locking part is supported on the locking protrusion as viewed from the outside.

As illustrated in FIGS. 6, 7 and 8, the second locking protrusion 225 of the first plate 220 is formed to protrude from the inside of the first plate 220. A height of the second locking protrusion 225 is provided lower than that of the side wall plate 222 by a predetermined distance, so the second plate 230 supported by the second locking protrusion 225 is prevented from deviating from the first plate 220 in the X direction or the Y direction. When the height of the first locking protrusion 224 is H1 and the height of the second locking protrusion 225 is H2, H1>H2 is satisfied. In this embodiment, it is illustrated that the second locking protrusion 225 is located close to the screw through hole 223, but the position of the second locking protrusion 225 does not necessarily have to be close to the screw through hole 223. However, due to the characteristic that the second locking protrusion 225 prevents the second plate 230 from falling and supports the second plate 230, the second locking protrusion 225 is preferably located close to the upper edge (that is, the end portion of the side wall plate 222 in the Z direction) of the side wall plate 222.

In addition, in this embodiment, it is illustrated that one region of the side wall plate 222 protrudes inward of the side wall plate 222 and the second locking protrusion 225 extends from the protrusion region of the side wall plate 222, but the shape, location, number, and the like of the second locking protrusion 225 are not limited to this embodiment. As long as the second locking protrusion 225 protrudes from the inner circumferential surface of the side wall plate 222 to prevent the second plate 230 from falling, the second locking protrusion 225 can have any structure.

The second locking part 236 of the second plate 230 is formed at the edge of the cover plate 232. In this embodiment, it is illustrated that the second locking part 236 is depressed inward from the edge of the cover plate 232, but is only provided in a shape corresponding to the second locking protrusion 225, and the shape of the second locking part 236 is not limited to any one. However, in the case where the second locking part 236 and the second locking protrusion 225 have a shape depressed in the overall housing, the second locking part 236 and the second locking protrusion 225 may support the second plate 230 against vibration acting in the transverse direction (X direction or Y direction).

Hereinafter, a structure of the discharge port of the second plate will be described.

Figure 9:
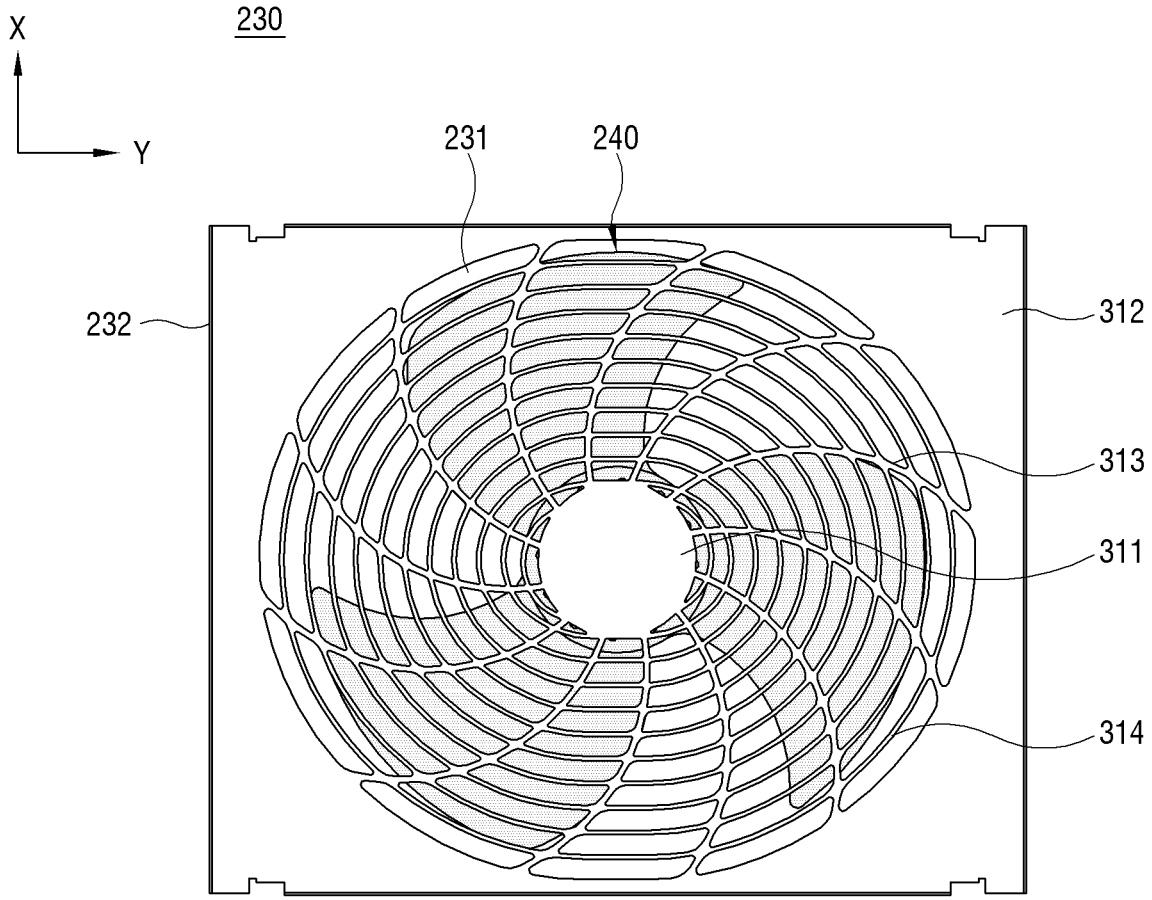
FIG. 9 is a plan view illustrating a discharge port of the second plate.

FIG. 9 is a plan view illustrating the discharge port of the second plate.

As illustrated in FIG. 9, in the second plate 230, the discharge port 231 is formed to penetrate through one region of the cover plate 232, for example, the central region of the cover plate 232. In this embodiment, the discharge port 231 is formed in such a way that the discharge port 231 penetrates through one region of the cover plate 232. However, depending on the design method, the components forming the discharge port 231 may not be integral with the cover plate 232, and such an embodiment will be described later.

The cover plate 232 may include the following structure to form the discharge port 231. When the fan 240 is provided under the cover plate 232, the cover plate 232 includes a central part 311 forming the central region in which the rotation axis of the fan 240 is located. The cover plate 232 includes a peripheral part 312 that surrounds the central part 311 adjacent to the four-way edges. The cover plate 232 includes a plurality of first frame parts 313 that extend from the central part 311 to the peripheral part 312 along the radial direction. The cover plate 232 includes a plurality of second frame parts 314 extending to connect between the two adjacent first frame parts 313. With this structure, the discharge port 231 including a plurality of through holes is formed on the cover plate 232.

The structure of the discharge port 231 is determined according to the shapes of the central part 311, the peripheral part 312, the first frame part 313, and the second frame part 314, and this structure may be variously provided depending on the design method. As one example, the first frame part 313 may not extend in a straight line, but may be bent corresponding to the rotation direction of the fan 240. When the fan 240 is provided to rotate clockwise, the first frame part 313 may also be bent clockwise, so the discharge of air through the discharge port 231 may be more smoothly performed.

As a spacing between the two adjacent second frame parts 314 increases, an area occupied by the discharge port 231 increases, and thus, the flow path resistance decreases, and as the spacing decreases, the area occupied by the discharge port 231 decreases, and thus, the rigidity is improved. Accordingly, the above-described spacing may be appropriately designed between the flow path resistance and the rigidity. For example, when the spacing is designed to be less than 24 mm, the flow resistance and the rigidity may be appropriately considered.

Further, a curvature of the second frame part 314 increases as the second frame part 314 approaches the central part 311, and the curvature decreases as the second frame part 314 approaches the peripheral part 312, so the second frame part 314 may extend to be closer to a straight line. As the distance from the central part 311 increases, the length of the second frame part 314 connecting between the two adjacent first frame parts 313 increases, so the demand for the rigidity of the second frame part 314 provided close to the peripheral part 312 increases. The rigidity of the second frame part 314 is reinforced by extending closer to a straight line as the second frame part 314 is closer to the peripheral part 312.

Meanwhile, in the above-described embodiment, the case where the entire second plate is made of a material having excellent corrosion resistance such as aluminum has been described. However, the idea of the disclosure is not limited to this case, and the present can be designed so that only at least a region with which the screw comes into contact in the second plate is made of a material having excellent corrosion resistance. Hereinafter, the embodiment will be described.

Figure 10:
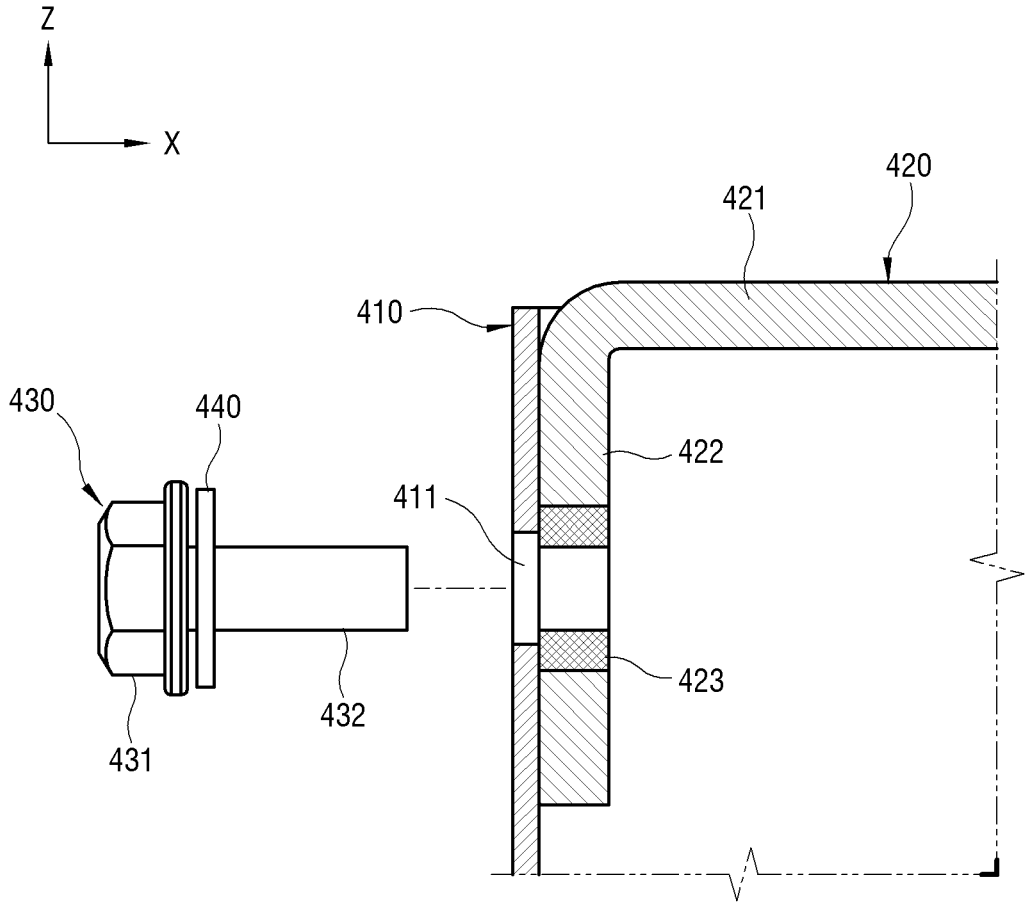
FIG. 10 is a side cross-sectional view of main parts illustrating the coupled structure of the first plate and the second plate by the screw when a material of the screw coupling part is different from that of the second plate.

FIG. 10 is a side cross-sectional view of main parts illustrating the coupled structure of the first plate and the second plate by the screw when a material of the screw coupling part is different from that of the second plate.

As illustrated in FIG. 10, a first plate 410 and a second plate 420 are coupled to each other by a screw 430. The first plate 410 is provided with a screw through hole 411. The second plate 420 is provided with a cover plate 421, a bent part 422, and a screw coupling part 423. A screw body 432 of the screw 430 penetrates through the screw through hole 411 without contacting the screw through hole 411 and is screwed to the screw coupling part 423. A washer 440 is interposed between a head 431 of the screw 430 and the first plate 410. The coupling method of the first plate 410 and the second plate 420 is substantially the same as in the above-described embodiment.

The second plate 420 in this embodiment is different from the above-described embodiment in terms of a material. For example, the cover plate 421 and the bent part 422 may be made of a steel plate as in the case of the first plate 410. However, different from the material of the bent part 422, the screw coupling part 423 may be made of a material such as aluminum having relatively strong corrosion resistance. That is, in this embodiment, the entire second plate 420 is not made of a material having excellent corrosion resistance, but only the screw coupling part 423 to which the screw 430 is screwed in the second plate 420 is a material having excellent corrosion resistance. The screw coupling part 423 includes, for example, a ring-shaped member that has a hole penetrating through a center thereof, and an inner circumferential surface of the central hole is provided with a thread so that the screw coupling part 423 is screwed to the screw body 432. The bent part 422 has a hole for housing and supporting the screw coupling part 423, and the screw coupling part 423 is fitted into such a hole of the bent part 422 or is coupled to the bent part 422 by various ways such as welding and bonding.

The design method may be applied when a level of rigidity required for the second plate 420 is high.

Hereinafter, embodiments of various structures of the first plate and the second plate will be described.

Figure 11:
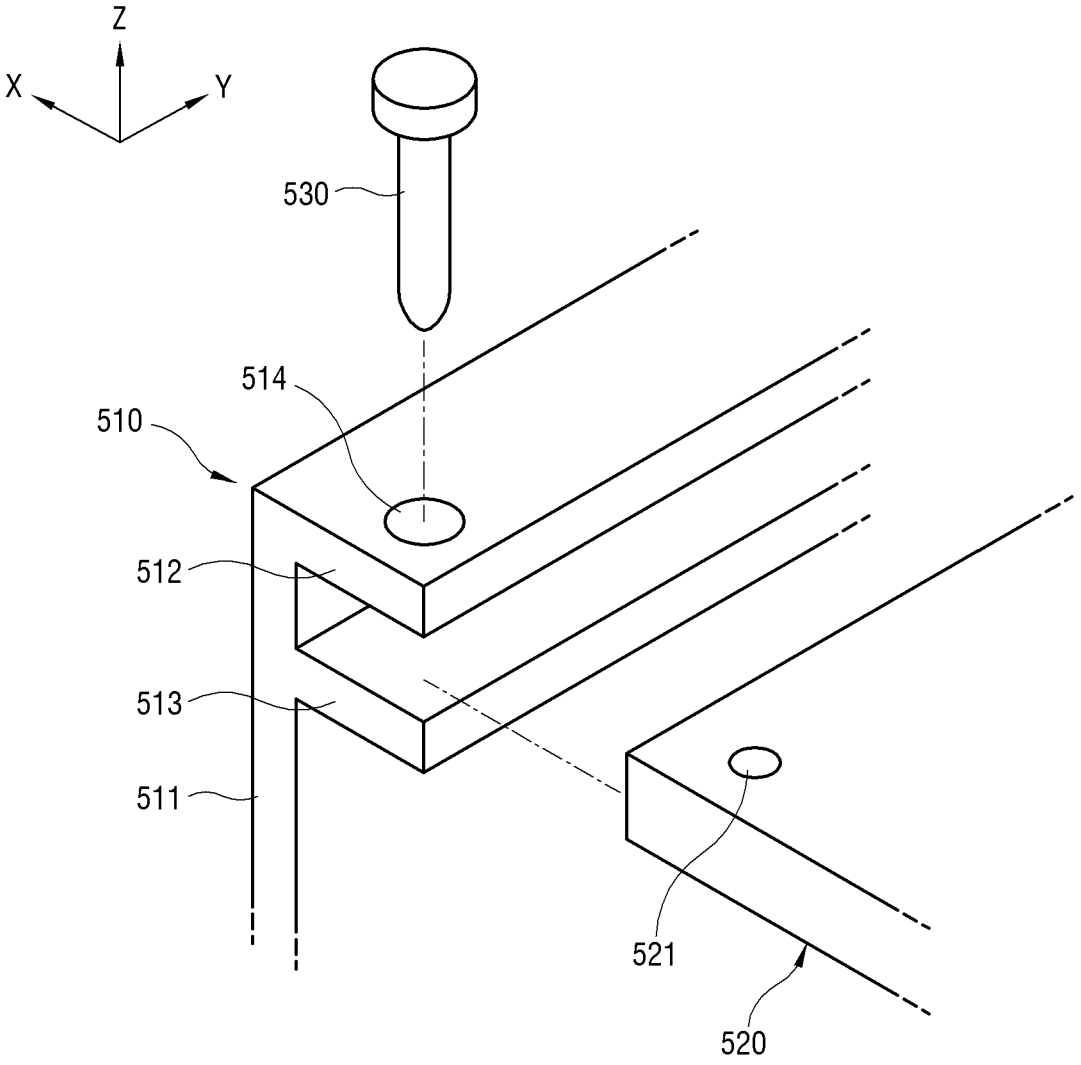
FIG. 11 is a perspective view of main parts illustrating an embodiment of a screw coupling structure of a first plate and a second plate.

FIG. 11 is a perspective view of main parts illustrating an embodiment of the screw coupling structure of the first plate and the second plate.

Figure 12:
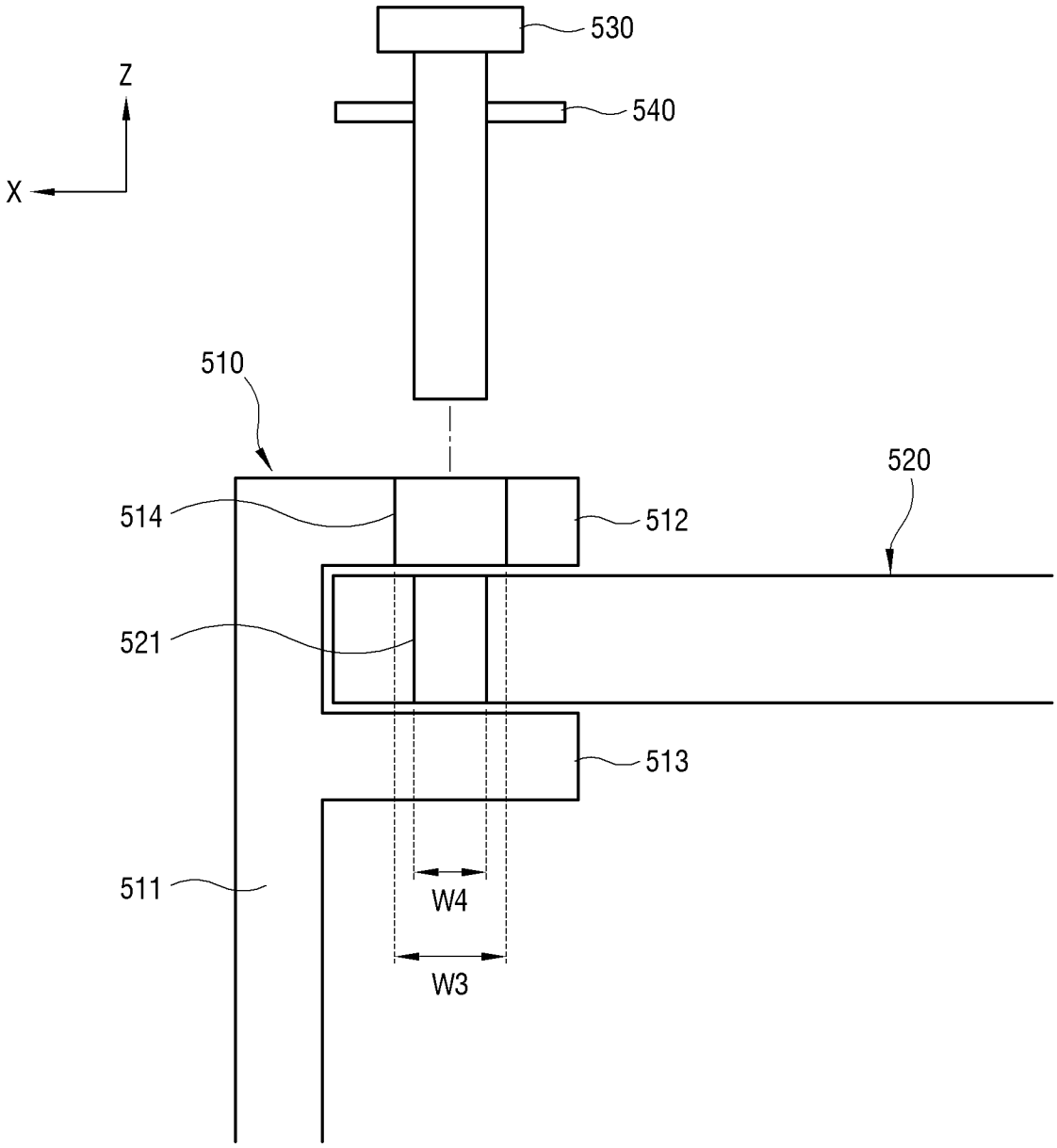
FIG. 12 is a side cross-sectional view of FIG. 11.

FIG. 12 is a side cross-sectional view of FIG. 11.

As illustrated in FIGS. 11 and 12, the housing of the outdoor unit includes a first plate 510 and a second plate 520. The first plate 510 includes an erected side wall plate 511. In addition, the first plate 510 has a side wall bent part 512 that is bent from one end portion of the side wall plate 511. In addition, the first plate 510 includes a locking protrusion 513 that protrudes from an inner circumferential surface of the side wall plate 511 under the side wall bent part 512. In this embodiment, only a left side (X direction side of the housing) of the housing is illustrated, but as the structure of this embodiment, a symmetric structure may be applied to a right side (−X direction side of the housing) of the housing. That is, the structure of this embodiment is symmetrically provided on the left and right sides of the housing when viewed in the Y direction.

The side wall plate 511 extends along the Z direction, whereas the side wall bent part 512 is bent orthogonally from the end portion of the side wall plate 511 in the Z direction to extend by a predetermined distance along the X direction. A screw through hole 514 is formed to penetrate the side wall bent part 512 along the Z direction. The side wall bent part 512 forms a housing space for accommodating an edge (that is, end portion of the second plate 520 in the X direction) of the second plate 520 together with the locking protrusion 513.

The locking protrusion 513 extends along the X direction parallel to the side wall bent part 512. The locking protrusion 513 is provided with a housing space for housing the edge of the second plate 520 between the side wall bent part 512 and the locking protrusion 513 by protruding close to the side wall bent part 512 under the side wall bent part 512. In addition, the locking protrusion 513 supports the second plate 520 to prevent the second plate 520 from falling in the −Z direction.

The second plate 520 includes a rectangular plate. A thickness of the edge of the second plate 520 is at least smaller than a distance between the side wall bent part 512 and the locking protrusion 513, and as a result, the edge of the second plate 520 may be housed between the side wall bent part 512 and the locking protrusion 513. The screw coupling part 521 for screwing with the screw 530 is formed to penetrate through one region of the edge of the second plate 520.

The housing space between the side wall bent part 512 and the locking protrusion 513 in the housing is opened in the Y direction side or the −Y direction side. Through the opened region, the second plate 520 slides to be detachable from the first plate 510 and is movable. That is, the edge of the second plate 520 in the X direction starts to be housed in the housing space from the −Y direction side of the side wall bent part 512, and the second plate 520 slides in the Y direction, so the second plate 520 is housed in the housing space described above. When the second plate 520 is separated from the first plate 510, the above-described operation proceeds in a reverse order.

When the second plate 520 slides to a position where the screw coupling part 521 corresponds to the screw through hole 514, the screw 530 is screwed to the screw coupling part 521 from an upper side of the side wall bent part 512, so the first plate 510 and the second plate 520 are coupled to each other. The screw 530 penetrates through the screw through hole 514 to be screwed to the screw coupling part 521.

Here, a diameter W3 of the screw through hole 514 is provided larger than a diameter W4 of the screw coupling part 521. In addition, while the screw 530 is screwed to the screw coupling part 521, a washer 540 is interposed between the screw 530 and the side wall bent part 512. As a result, the screw 530 is screwed to the screw coupling part 521, and the screw 530 does not come into contact with the first plate 510 including the side wall bent part 512.

In the case where the second plate 520 is made of a material having higher corrosion resistance than that of the first plate 510, the structure of this embodiment minimizes the region in which the screw 530 may come into direct contact with the first plate 510 to suppress the corrosion of the first plate 510.

In this embodiment, the case where the side wall bent part 512 is bent orthogonally from the side wall plate 511 has been described. However, since the side wall bent part 512 is not necessarily designed to be orthogonal to the side wall plate 511, such an embodiment will be described below.

Figure 13:
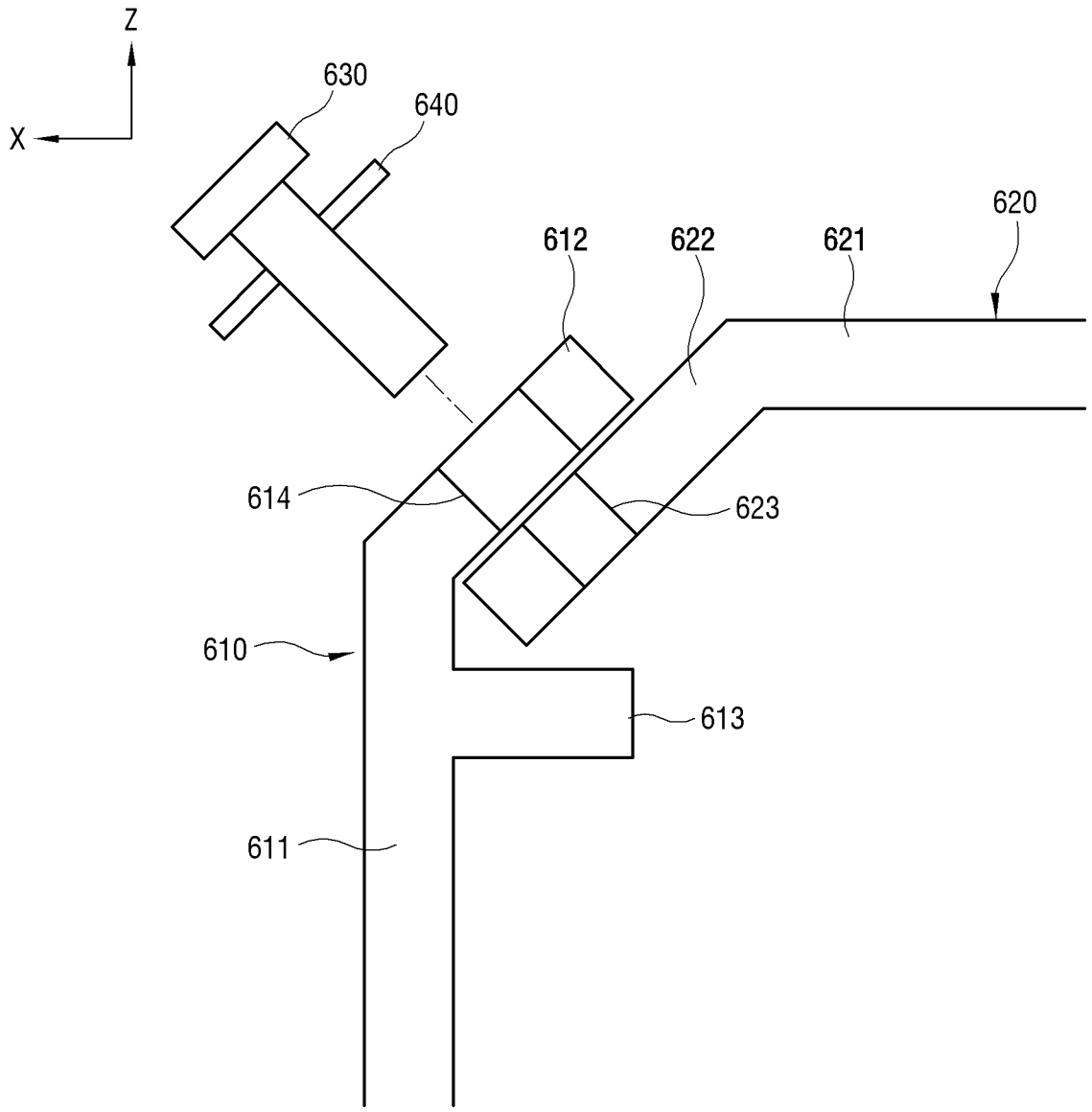
FIG. 13 is a side cross-sectional view illustrating another embodiment of the screw coupling structure of the first plate and the second plate.

FIG. 13 is a side cross-sectional view illustrating another embodiment of the screw coupling structure of the first plate and the second plate.

As illustrated in FIG. 13, the housing of the outdoor unit includes a first plate 610 and a second plate 620. The first plate 610 includes an erected side wall plate 611. In addition, the first plate 610 has a side wall bent part 612 that is bent from one end portion of the side wall plate 611. In addition, the first plate 610 includes a locking protrusion 613 that protrudes from an inner circumferential surface of the side wall plate 611 under the side wall bent part 612. In this embodiment, only a left side (X direction side of the housing) of the housing is illustrated, but as the structure of this embodiment, a symmetric structure may be applied to a right side (−X direction side of the housing) of the housing. That is, the structure of this embodiment is symmetrically provided on the left and right sides of the housing when viewed in the Y direction.

The side wall bent part 612 extends to be inclined at a predetermined angle with respect to an extending direction of the side wall plate 611. The angle is not limited to a specific value and may be determined depending on various design methods. However, the side wall bent part 612 is bent upward from the side wall plate 611. In addition, a screw through hole 614 is formed to penetrate through the side wall bent part 612 in a direction orthogonal to the extending direction of the side wall bent part 612. The locking protrusion 613 protrudes from the inside of the side wall plate 611 to be close to the side wall bent part 612, thereby preventing the second plate 620 from falling.

The second plate 620 includes a cover plate 621. An extending direction of the cover plate 621 is substantially orthogonal to the extending direction of the side wall plate 611. In addition, the second plate 620 has a bent part 622 that extends to be bent at a predetermined angle from one end portion of the cover plate 621. The angle at which the bent part 622 is bent corresponds to the angle at which the side wall bent part 612 is bent. As a result, when the bent part 622 is supported by the locking protrusion 613, the side wall bent part 612 and the bent part 622 are provided to face parallel to each other.

A method in which the second plate 620 is detached from the first plate 610 is similar to that of the above-described embodiment, and therefore, a description thereof will be omitted.

The first plate 610 and the second plate 620 are coupled to each other by screwing the screw 630 to the screw coupling part 623 from the upper side of the side wall bent part 612. The screw 630 penetrates through the screw through hole 614 from a direction orthogonal to a plate surface of the side wall bent part 612 to be screwed to the screw coupling part 623. Here, a diameter of the screw through hole 614 is provided larger than that of the screw coupling part 623. In addition, while the screw 630 is screwed to the screw coupling part 623, a washer 640 is interposed between the screw 630 and the side wall bent part 612. As a result, the screw 630 does not come into contact with the first plate 610 including the side wall bent part 612 while being screwed to the screw coupling part 623.

Meanwhile, in the above-described embodiment, the structure in which the discharge port is formed by cutting a partial region on the cover plate of the second plate has been described. However, depending on the design method, the second plate may not have a single structure of the cover plate, and this embodiment will be described below.

Figure 14:
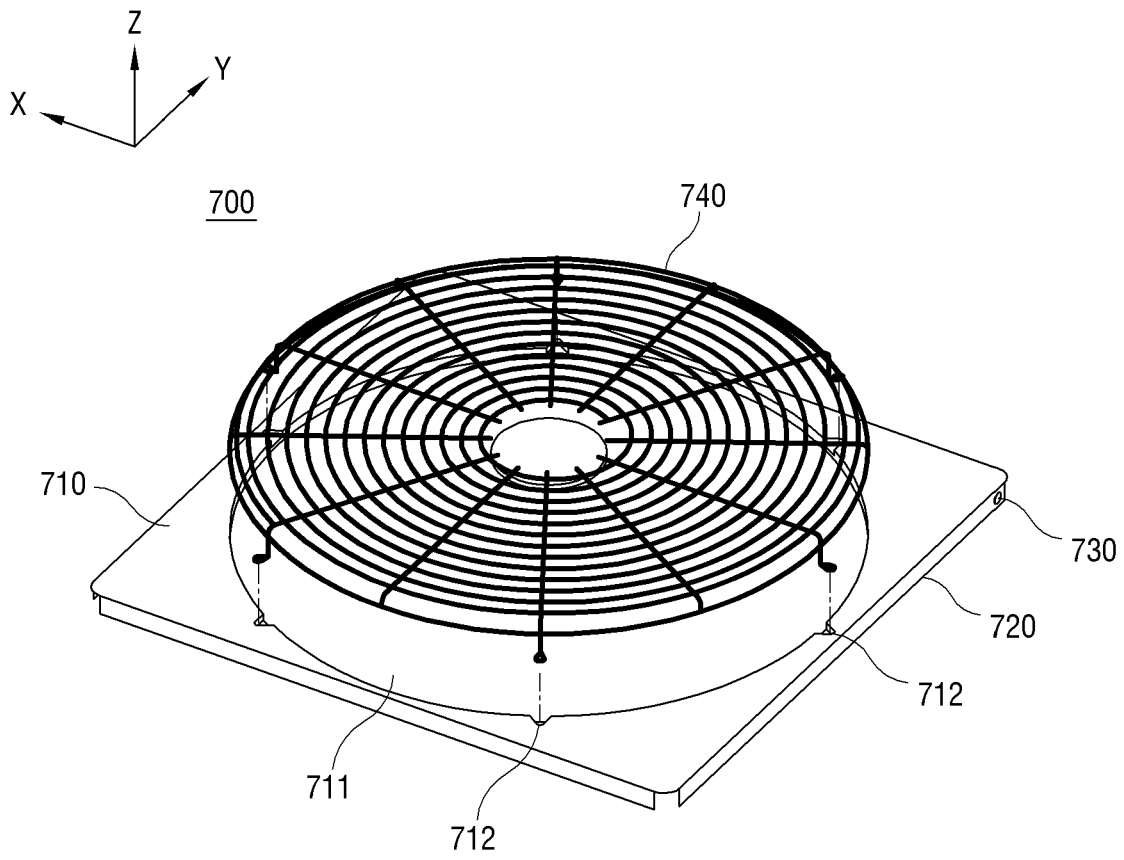
FIG. 14 is a perspective view showing a structure in which the second plate includes a mesh forming the discharge port.

FIG. 14 is a perspective view illustrating a structure in which the second plate includes a mesh forming the discharge port.

As illustrated in FIG. 14, a second plate 700 includes a cover plate 710 implemented as a rectangular plate. In addition, the second plate 700 includes a bent part 720 that is bent downward from an edge of the cover plate 710. A screw coupling part 730 is provided on the bent part 720 so as to perform screw coupling by a screw. The configuration of the bent part 720 and the screw coupling part 730 may be applied to the above-described embodiment, and therefore, a detailed description thereof will be omitted.

An opening 711 is formed in a central region of the cover plate 710. A mesh coupling part 712 is provided on an inner circumferential surface of the opening 711 in the cover plate 710 so that the mesh coupling part 712 is coupled to a mesh 740. The mesh coupling part 712 protrudes from the inner circumferential surface of the opening 711 toward a center of the opening 711. A plurality of mesh coupling parts 712 are arranged at equal intervals along the inner circumferential surface of the opening 711, so the mesh 740 can be stably supported with respect to the cover plate 710. The mesh coupling part 712 may include, for example, a hole for screw coupling, or may include a locking part into which a portion of the mesh 740 is fitted.

The mesh 740 covers the opening 711 while being coupled to the mesh coupling part 712. At least some region of the mesh 740 penetrates to form the discharge port, and the mesh 740 may be implemented by, for example, an assembly of metal wires or a plate with perforations. The mesh 740 may be coupled to the cover plate 710 by screwing some region of the edge to the mesh coupling part 712.

As such, the second plate 700 may have various structures.

On the other hand, when the first plate includes a material having excellent corrosion resistance, depending on the design method, the screw may be provided to come into contact with the first plate. Hereinafter, the embodiment will be described.

Figure 15:
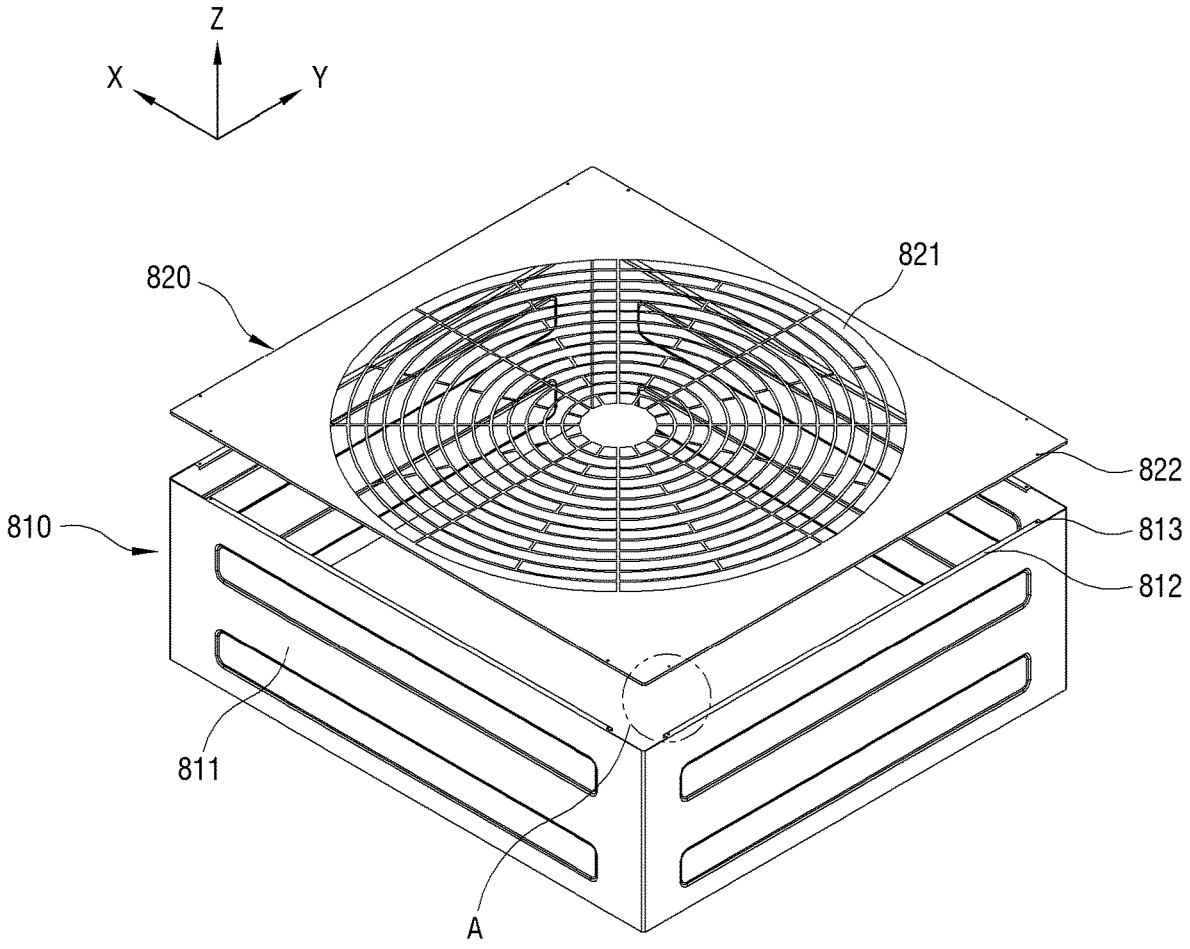
FIG. 15 is a side cross-sectional view of main parts illustrating another embodiment of the screw coupling structure of the first plate and the second plate.

FIG. 15 is a side cross-sectional view of main parts illustrating another embodiment of the screw coupling structure of the first plate and the second plate.

Figure 16:
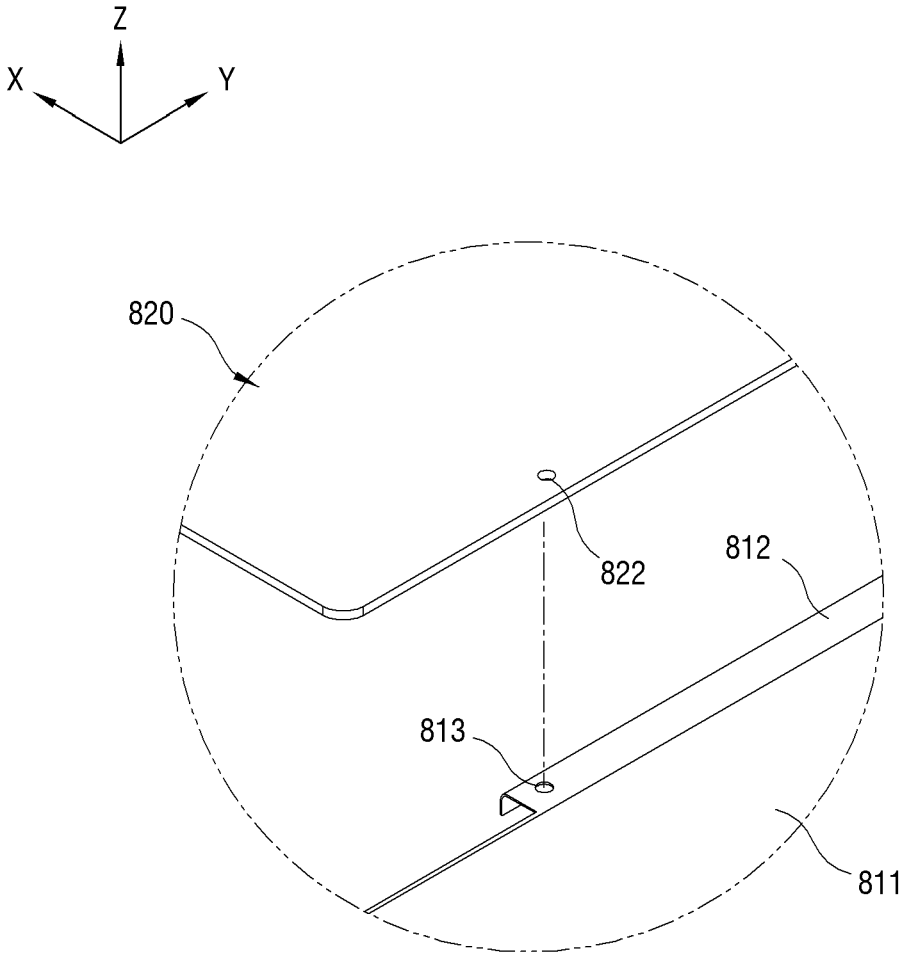
FIG. 16 is a perspective view illustrating an enlarged state of region A of FIG. 15.

FIG. 16 is a perspective view illustrating an enlarged state of region A of FIG. 15.

As illustrated in FIGS. 15 and 16, a first plate 810 and a second plate 820 are provided to be coupled. The first plate 810 is erected and extended and includes a side wall plate 811 forming a housing space therein. In addition, the first plate 810 includes a side wall bent part 812 that is bent to be orthogonal from an upper edge of the side wall plate 811, that is, an end portion of the side wall plate 811 in the Z direction. A screw coupling part 813 for screw coupling is formed to penetrate through one region of the side wall bent part 812.

The second plate 820 is a rectangular plate and has a discharge port 821 formed in a central region thereof. A screw through hole 822 provided to penetrate the screw therethrough is formed to penetrate through the edge region of the second plate 820.

The side wall bent part 812 comes into contact with the second plate 820 to couple the second plate 820 and prevent the second plate 820 from falling. The second plate 820 is supported on the side wall bent part 812, and the screw through hole 822 of the second plate 820 is located to communicate with the screw coupling part 813 of the first plate 810. In this state, the screw penetrates through the screw through hole 822 from the upper side of the second plate 820 and is screwed to the screw coupling part 813.

Hereinafter, the form in which the first plate 810 and the second plate 820 are coupled to each other by the screw will be described.

Figure 17:
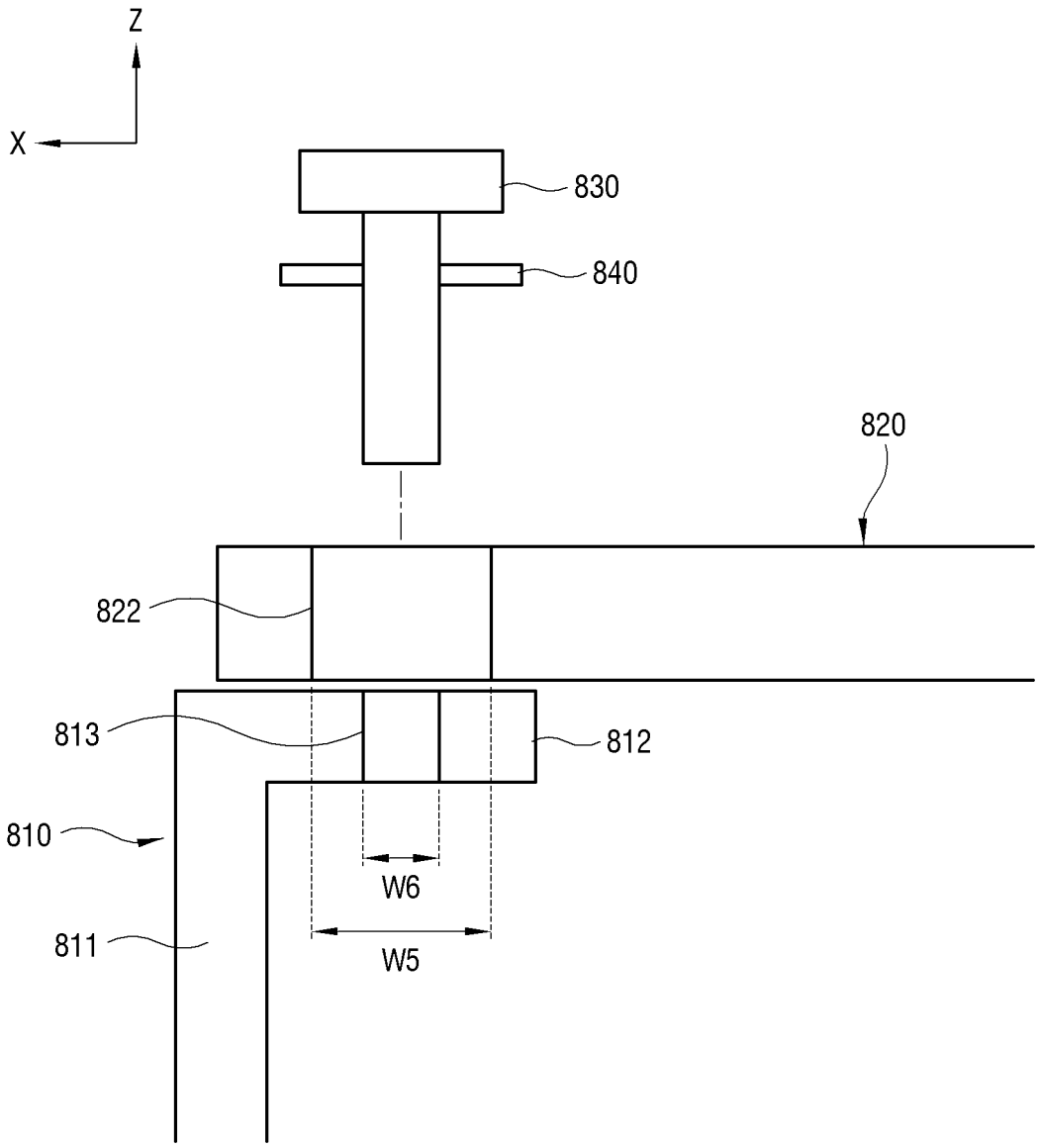
FIG. 17 is a side cross-sectional view of main parts illustrating a state in which the first plate and the second plate are coupled to each other by the screw in FIG. 15.

FIG. 17 is a side cross-sectional view of main parts illustrating a state in which the first plate and the second plate are coupled to each other by the screw in FIG. 15.

As illustrated in FIG. 17, the first plate 810 and the second plate 820 are screwed to each other by the screw. The first plate 810 is erected and extended and includes the side wall plate 811 forming a housing space therein. In addition, the first plate 810 includes the side wall bent part 812 that is bent orthogonally from an upper edge of the side wall part 812. The screw coupling part 813 for screw coupling is formed to penetrate through one region of the side wall bent part 812. The second plate 820 includes a rectangular plate provided with the discharge port. The screw through hole 822 is form on a region close to the edge of the second plate 820 to penetrate through the second plate 820.

In this embodiment, a diameter W5 of the screw through hole 822 is provided larger than a diameter W6 of the screw coupling part 813, so the screw 830 does not come into contact or comes into minimal contact with the screw through hole 822 while the screw 830 penetrates through the screw through hole 822 and is screwed to the screw coupling part 813. In addition, a washer 840 is interposed between the screw 830 and the second plate 820. Accordingly, the screw 830 coupled to the screw coupling part 813 is provided to come into minimal contact with the second plate 820.

When the first plate 810 has higher corrosion resistance than that of the second plate 820, according to the structure of this embodiment, the contact between the screw 830 and the second plate 820 is blocked, so the second plate 820 may be suppressed from corroding.

Meanwhile, the above-described embodiment has described the case where the second plate provided with the discharge port is an upper plate surface of a housing of the outdoor unit. However, depending on the design method of the outdoor unit, the second plate provided with the discharge port may be a front plate surface of the housing of the outdoor unit. This case corresponds to only to the extent that the direction of the second plate is changes in the above-described embodiment. Therefore, regarding the case where the second plate covers the front side of the housing, the case where the second plate covers the upper side of the housing may be applied. Hereinafter, the embodiment will be described.

Figure 18:
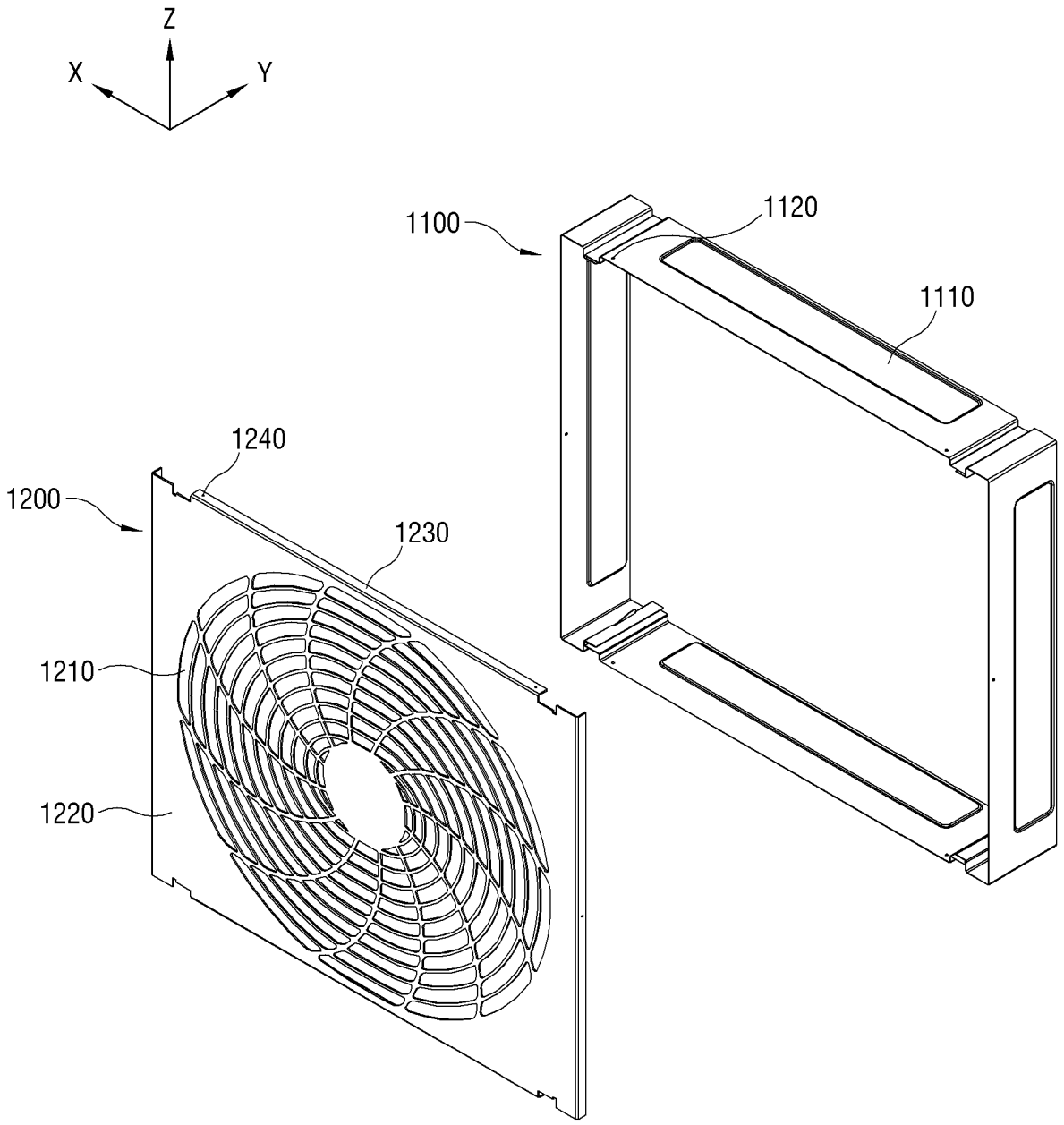
FIG. 18 is a perspective view of main parts illustrating a state in which the second plate provided to cover a front surface of the housing of the outdoor unit is separated from the first plate.

FIG. 18 is a perspective view of main parts illustrating a state in which the second plate provided to cover a front surface of the housing of the outdoor unit is separated from the first plate.

As illustrated in FIG. 18, in this embodiment, the entire of a first plate 1100 is not illustrated, but only upper main parts of the first plate 1100 to which a second plate 1200 is coupled and supported is illustrated.

The first plate 1100 includes a side wall plate 1110 that is erected to form a housing space in the housing 210. In the side wall plate 1110, two pairs of side wall plates 1110 extending in parallel along a Y direction form a rectangular pillar. An end portion of the first plate 1100 in a front direction, that is, in a −Y direction, which is constituted by the side wall plate 1110, is opened, so the air inside the first plate 1100 is discharged to the outside.

The first plate 1100 includes a screw through hole 1120 that is formed close to one region of the side wall plate 1110, for example, a front edge of the side wall plate 1110 to penetrate through the side wall plate 1110.

The second plate 1200 includes a cover plate 1220 that has the discharge port 1210 formed in a central region thereof. The cover plate 1220 corresponds to the shape of the opening of the first plate 1100 and has a size to cover the opening of the first plate 1100. The cover plate 1220 has a rectangular plate surface parallel to an X-Z plane in FIG. 18.

In addition, the second plate 1200 has a bent part 1230 that is bent backward from the cover plate 1220. The bent part 1230 extends orthogonally in a Y direction by a predetermined length from the edge of the cover plate 1220 toward the first plate 1100. The extended length or shape of the bent part 1230 is not limited. The bent part 1230 may be provided at all four-way edges of the rectangular cover plate 1220, or may be provided only at two edges facing each other among the four-way edges of the cover plate 1220.

The bent part 1230 is provided to be housed in the first plate 1100, that is, into the housing when the second plate 1200 is supported by the first plate 1100. To this end, a width of the cover plate 1220 in contact with the bent part 1230 is provided smaller than that of the opening of the first plate 1100, so all the bent parts 1230 of the second plate 1200 may be provided to be inserted into the inside of the first plate 1100.

In addition, the second plate 1200 includes the screw coupling part 1240 that includes a coupling hole formed to penetrate through the bent part 1230 so that the screw is coupled to the second plate 1200. The screw coupling part 1240 extends orthogonal to the extending direction of the bent part 1230, that is, parallel to the X direction or the Z direction. The screw coupling part 1240 has a thread formed on an inner circumferential surface thereof that is formed to penetrate through the bent part 1230, and thus is provided to be screwed to a screw 1300.

Hereinafter, the coupled structure of the first plate 1100 and the second plate 1200 will be described in more detail.

Figure 19:
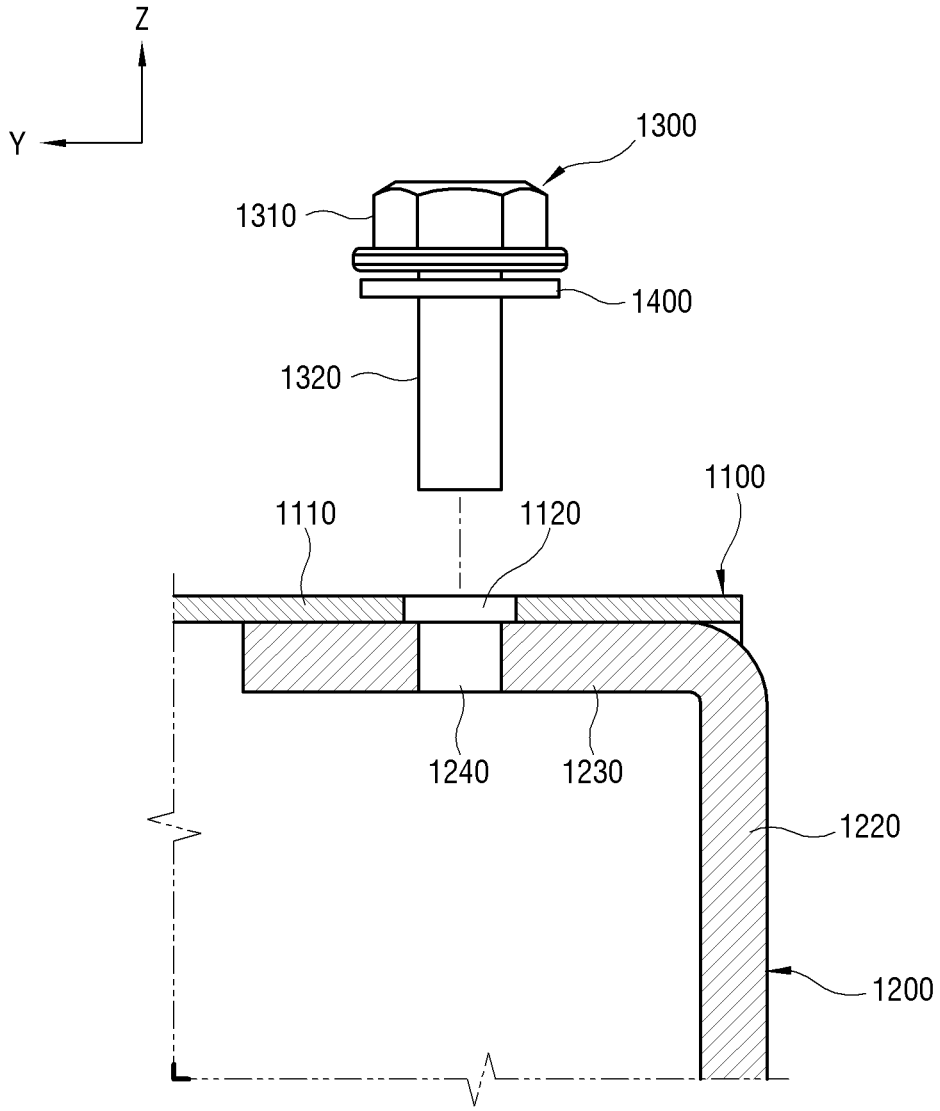
FIG. 19 is a side cross-sectional view of main parts illustrating the screw coupling structure of the first plate and the second plate of FIG. 18.

FIG. 19 is a side cross-sectional view of main parts illustrating the screw coupling structure of the first plate and the second plate of FIG. 18.

As illustrated in FIG. 19, the cover plate 1220 of the second plate 1200 faces forward (right side of FIG. 19), and the bent part 1230 is provided to be housed inside the first plate 1100. The screw through hole 1120 of the first plate 1100 and the screw coupling part 1240 of the second plate 1200 are provided at positions corresponding to each other.

In this state, the screw 1300 penetrates through the screw through hole 1120 from the outside of the first plate 1100 in the case of FIG. 19 and is screwed to the screw coupling part 1240. The screw 1300 includes a head 1310 and a screw body 1320 that extends from the head 1310 to a predetermined length and has a thread provided to be screwed to an outer circumferential surface thereof.

A diameter of the screw coupling part 1240 corresponds to that of the screw body 1320, so the screw body 1320 and the screw coupling part 1240 are screwed to each other. Here, the diameter of the screw through hole 1120 is provided larger than that of the screw body 1320 or the screw coupling part 1240, so the screw body 1320 screwed to the screw coupling part 1240 is provided not to come into contact with the screwed through hole 1120. In addition, a washer 1400 is interposed between the head 1310 and the first plate 1100. The washer 1400 prevents the head 1310 from coming into contact with the first plate 1100 while the screw body 1320 is screwed to the screw coupling part 1240. As a result, the screw 1300 does not come into contact with the first plate 1100 having relatively weak corrosion resistance, and the screw 1300 comes into contact with only the second plate 1200 having relatively strong corrosion resistance.

Hereinafter, embodiments of various coupled structures of the first plate and the second plate will be described.

Figure 20:
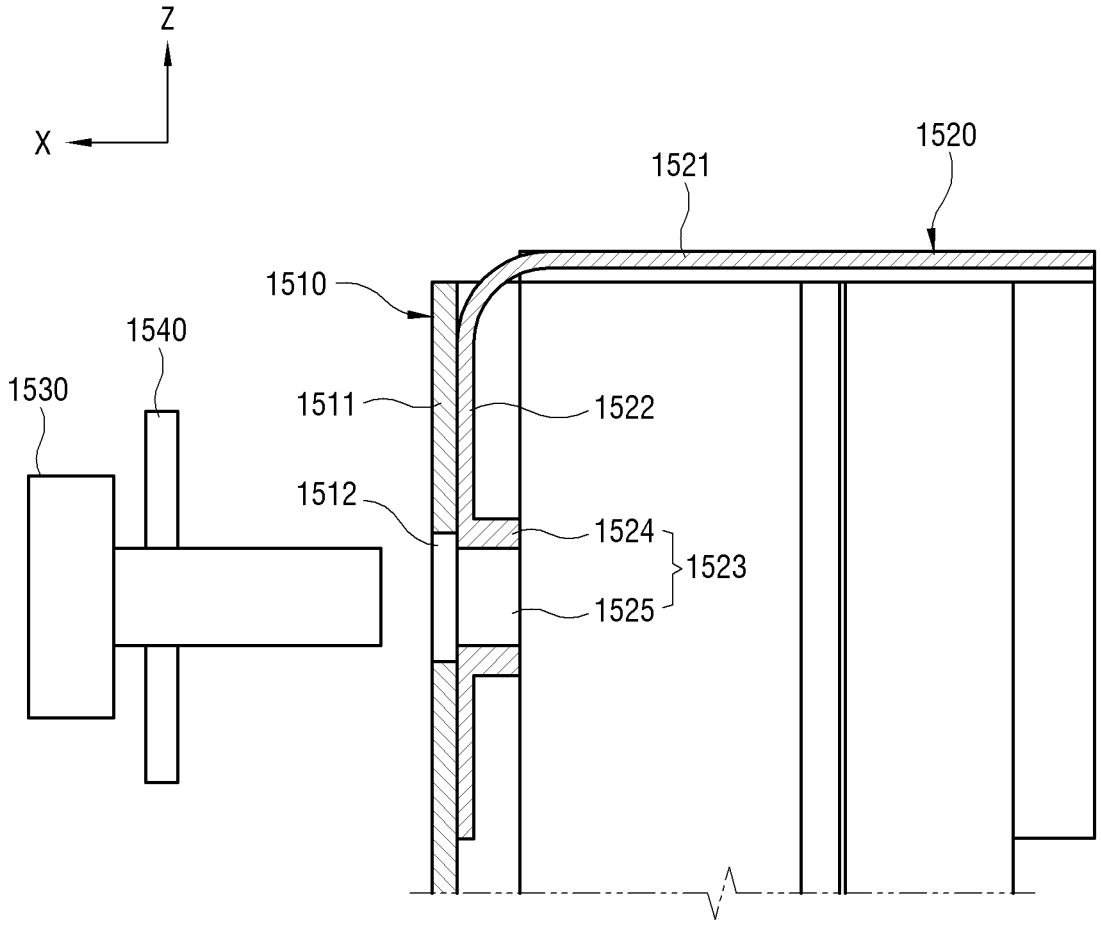
FIG. 20 is a side cross-sectional view illustrating another embodiment of the screw coupling structure of the first plate and the second plate.

FIG. 20 is a side cross-sectional view illustrating another embodiment of the screw coupling structure of the first plate and the second plate.

As illustrated in FIG. 20, the housing of the outdoor unit includes a first plate 1510 and a second plate 1520. The first plate 1510 includes an erected side wall plate 1511. In addition, the first plate 1510 includes a screw receiving hole 1512 formed to penetrate through the side wall plate 1511 so that a screw 1530 may penetrate through the screw receiving hole 1512.

The second plate 1520 includes a cover plate 1521 for covering an upper side of the first plate 1510. The second plate 1520 includes a bent part 1522 that is bent downward from an edge of the cover plate 1521. The cover plate 1521 or the bent part 1522 according to the present embodiment may be provided to have a relatively thin thickness compared to the case of the above-described embodiment within a range in which rigidity is secured.

In addition, the second plate 1520 includes a screw coupling part 1523 provided for screw coupling. The screw coupling part 1523 needs to have a thread of an appropriate length so that the screw 1530 is stably screwed. However, since a thickness of the bent part 1522 is shorter than an appropriate length of the thread, a thickness of the screw coupling part 1523 is provided thicker than that of the bent part 1522.

A screw coupling part body 1524 extends from the bent part 1522 toward the inside of the first plate 1510 and a screw coupling hole 1525 for screw coupling is formed along an extending direction of the screw coupling part body 1524 to penetrate through the screw coupling part body 1524, and as a result, the screw coupling part 1523 is implemented. With this structure, even when the thickness of the cover plate 1521 or the bent part 1522 is designed to be relatively thin, the screw coupling by the screw 1530 can be made.

The diameter of the screw coupling hole 1525 corresponds to the diameter of the screw 1530 so that the screw coupling by the screw 1530 is possible. Meanwhile, the diameter of the screw receiving hole 1512 is larger than the diameter of the screw coupling hole 1525 and the diameter of the screw 1530.

As for the coupling method of the first plate 1510 and the second plate 1520 using the screw 1530 and the washer 1540, the above-described embodiment may be applied, and thus a detailed description thereof will be omitted.

Figure 21:
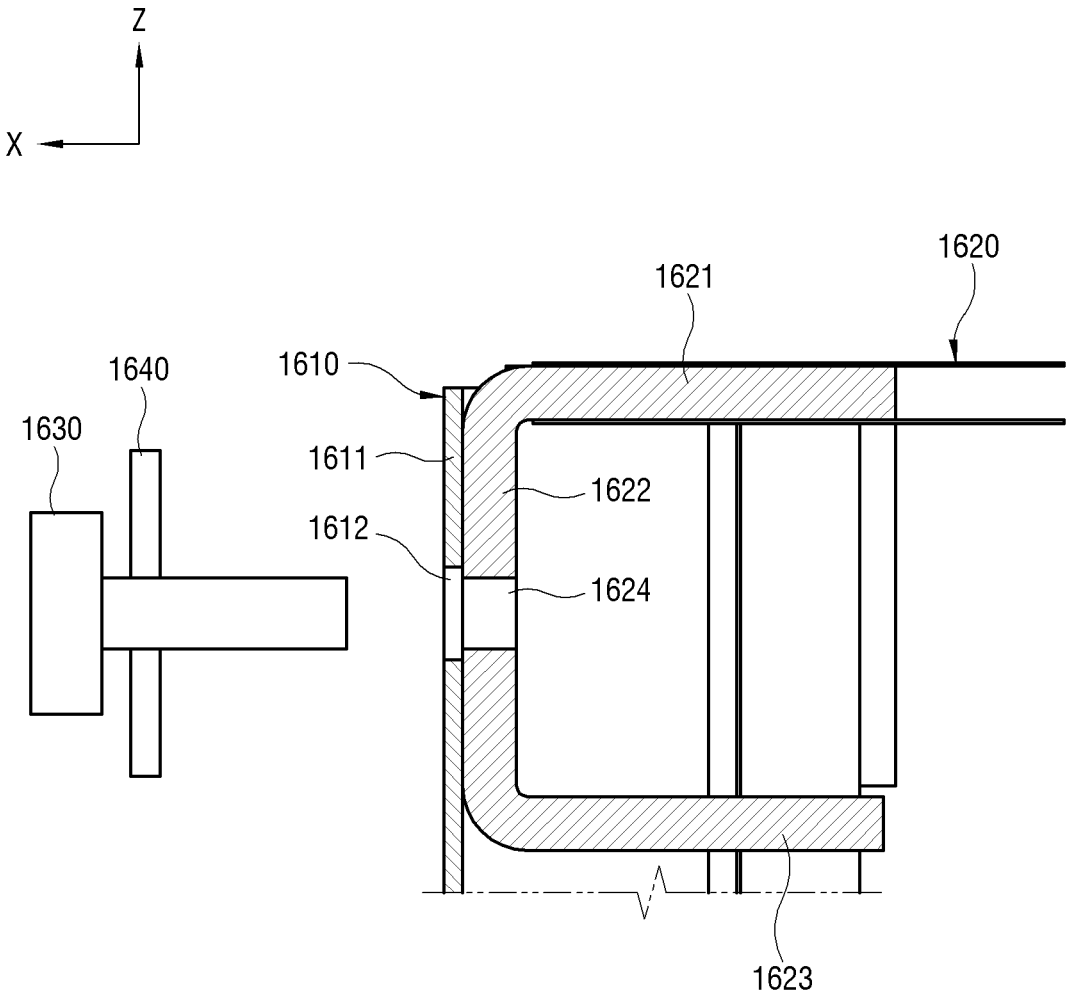
FIG. 21 is a side cross-sectional view illustrating another embodiment of the screw coupling structure of the first plate and the second plate.

FIG. 21 is a side cross-sectional view illustrating another embodiment of the screw coupling structure of the first plate and the second plate.

As illustrated in FIG. 21, the housing of the outdoor unit includes a first plate 1610 and a second plate 1620. The first plate 1610 includes an erected side wall plate 1611. In addition, the first plate 1610 includes a screw receiving hole 1612 formed to penetrate through the side wall plate 1611 so that a screw 1630 may penetrate through the screw receiving hole 1612.

The second plate 1620 includes a cover plate 1621 for covering an upper side of the first plate 1610. The second plate 1620 includes a bent part 1622 that is bent downward from an edge of the cover plate 1621. In addition, the second plate 1620 includes a second bent part 1623 bent from an end portion of the first bent part 1622. The second bent part 1623 is parallel to the cover plate 1621 and extends inward of the cover plate 1621. That is, the second plate 1620 has a shape in which an edge portion is rolled inward when viewed as a whole. Such a structure may further improve the rigidity of the second plate 1620.

The second plate 1620 includes a screw coupling part 1624 formed to penetrate through the first bent part 1622 for screw coupling.

As for the coupling method of the first plate 1610 and the second plate 1620 using the screw 1630 and the washer 1640, the above-described embodiment may be applied, and thus a detailed description thereof will be omitted.

Figure 22:
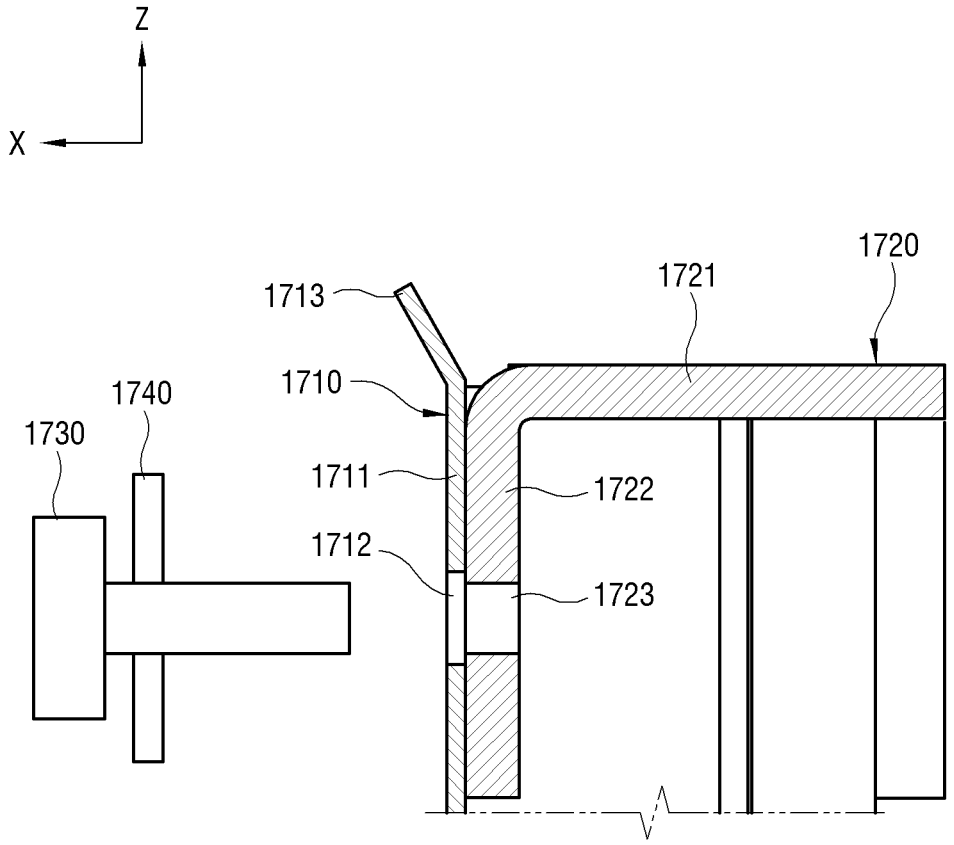
FIG. 22 is a side cross-sectional view illustrating another embodiment of the screw coupling structure of the first plate and the second plate.

FIG. 22 is a side cross-sectional view illustrating another embodiment of the screw coupling structure of the first plate and the second plate.

As illustrated in FIG. 22, the housing of the outdoor unit includes a first plate 1710 and a second plate 1720. The first plate 1710 includes an erected side wall plate 1711. In addition, the first plate 1710 includes a screw receiving hole 1712 formed to penetrate through the side wall plate 1711 so that a screw 1730 may penetrate through the screw receiving hole 1712.

In addition, the first plate 1710 includes a side wall bent part 1713 that is bent and extends from an upper edge of the side wall plate 1711. The side wall bent part 1713 extends to be inclined at a predetermined angle toward an outside of the first plate 1710. The side wall bent part 1713 makes it easy to place the second plate 1720 on an upper side of the first plate 1710, and thus, the assembling is easy.

The second plate 1720 includes a cover plate 1721 for covering an upper side of the first plate 1710. The second plate 1720 includes a bent part 1722 that is bent downward from an edge of the cover plate 1721. The second plate 1720 includes a screw coupling part 1723 for screw coupling which is formed to penetrate through the bent part 1722.

As for the coupling method of the first plate 1710 and the second plate 1720 using the screw 1730 and a washer 1740, the above-described embodiment may be applied, and thus, a detailed description thereof will be omitted.

Figure 23:
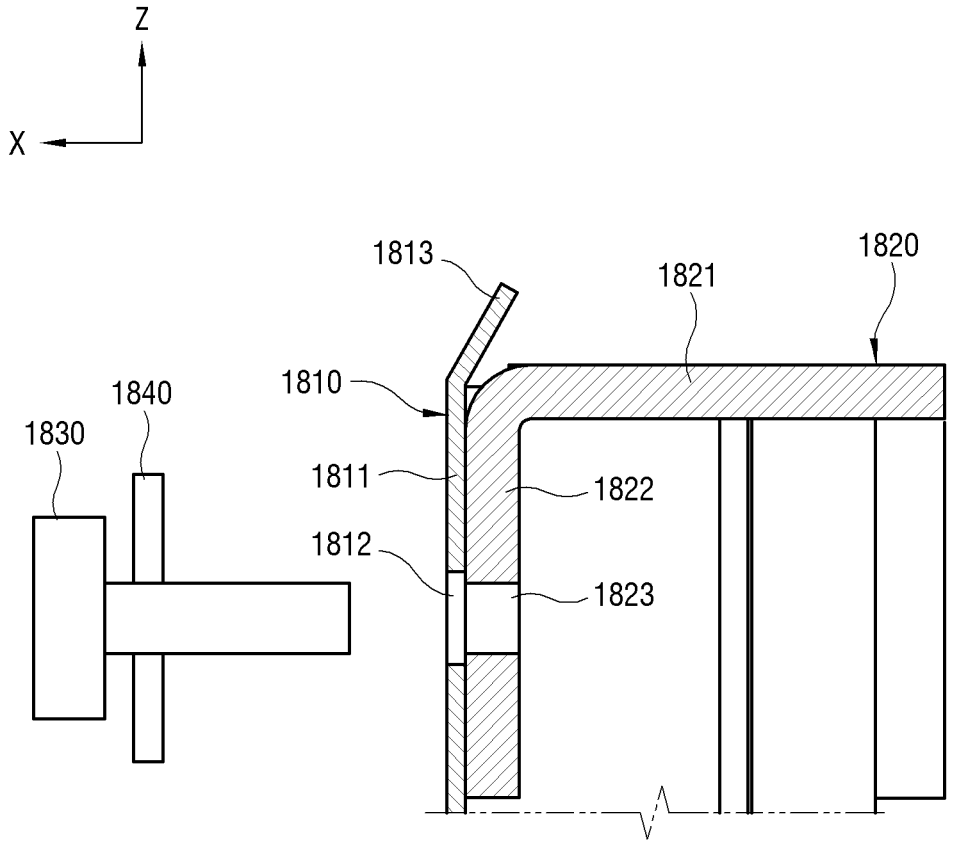
FIG. 23 is a side cross-sectional view illustrating another embodiment of the screw coupling structure of the first plate and the second plate.

FIG. 23 is a side cross-sectional view illustrating another embodiment of the screw coupling structure of the first plate and the second plate.

As illustrated in FIG. 23, the housing of the outdoor unit includes a first plate 1810 and a second plate 1820. The first plate 1810 includes an erected side wall plate 1811. In addition, the first plate 1810 includes a screw receiving hole 1812 formed to penetrate through a side wall plate 1811 so that a screw 1830 may penetrate through the screw receiving hole 1812.

In addition, the first plate 1810 includes a side wall bent part 1813 that is bent and extends from an upper edge of the side wall plate 1811. The side wall bent part 1813 extends to be inclined at a predetermined angle toward an inside of the first plate 1810. The side wall bent part 1813 may suppress moisture such as rainwater from penetrating into a region (that is, the screw receiving hole 1812, the screw coupling part 1823, and the like) where the screw 1830 to be described later is screwed, and thus, the corrosion resistance is improved.

The second plate 1820 includes a cover plate 1821 for covering an upper side of the first plate 1810. The second plate 1820 includes a bent part 1822 that is bent downward from an edge of the cover plate 1821. The second plate 1820 includes a screw coupling part 1823 for screw coupling which is formed to penetrate through the bent part 1822.

As for the coupling method of the first plate 1810 and the second plate 1820 using the screw 1830 and a washer 1840, the above-described embodiment may be applied, and thus a detailed description thereof will be omitted.

What is claimed is:

1. An air conditioner, comprising:
an indoor unit; and
an outdoor unit configured to circulate a refrigerant between the indoor unit and the outdoor unit, and including:
a heat exchanger that performs heat exchange between air and the refrigerant, and
a housing that houses the heat exchanger and includes:
a first plate surrounding the heat exchanger, with an edge on a side of the first plate forming an opening; and
a second plate covering the opening, and including:
a discharge port through which air in the housing having been heat exchanged with the refrigerant by the heat exchanger is dischargeable to outside of the housing, and
a screw coupling part to screw couple the second plate and the first plate together,
wherein the second plate is made of a material having a greater corrosion resistance than the first plate.

2. The air conditioner of claim 1, wherein
the screw coupling part has a coupling hole,
the first plate has a screw through hole having a larger diameter than the coupling hole, and
the air conditioner further comprises a screw having a main body penetrating the screw through hole and the coupling hole, and screwed to the screw coupling part.

3. The air conditioner of claim 1, wherein
the second plate comprises:
a main body, and
a bent part that is bent from an edge of the main body and extends parallel to the first plate, and
the screw coupling part is formed in the bend part.

4. The air conditioner of claim 1, wherein the first plate and the second plate are screwed to each other in order from the outside of the housing.

5. The air conditioner of claim 1, further comprising:
a screw passing through the first plate and screw coupled to the screw coupling part to screw couple the second plate and the first plate together; and
a washer made of a soft material interposed between a screw head of the screw and the first plate.

6. The air conditioner of claim 1, wherein
the first plate forms a vertical wall of the housing, and
the second plate is above the first plate.

7. The air conditioner of claim 1, wherein the first plate and/or the second plate is made of a metal material.

8. The air conditioner of claim 7, wherein
the first plate is made of steel, and
the screw coupling part is made of aluminum.

9. The air conditioner of claim 7, wherein a thickness of the second plate is provided in a range of 2.5 to 3 mm.

10. The air conditioner of claim 1, wherein an outer surface of the first plate is coated with a paint having corrosion resistance.

11. The air conditioner of claim 1, wherein the discharge port of the second plate has a mesh shape.

12. The air conditioner of claim 1, wherein
the housing further includes a mesh, and
the second plate further includes a mesh coupling part that is screwed to the mesh so that the mesh covers the discharge port and has greater corrosion resistance than that of the mesh.

13. The air conditioner of claim 1, wherein the first plate includes a locking protrusion protruding from the first plate to support an edge of the second plate.

* * * * *